US010991538B2

(12) United States Patent
Yun et al.

(10) Patent No.: US 10,991,538 B2
(45) **Date of Patent: *Apr. 27, 2021**

(54) HIGH BRIGHTNESS X-RAY REFLECTION SOURCE

(71) Applicant: Sigray, Inc., Concord, CA (US)

(72) Inventors: Wenbing Yun, Walnut Creek, CA (US); Sylvia Jia Yun Lewis, San Francisco, CA (US); Janos Kirz, Berkeley, CA (US); William Henry Hansen, Genola, UT (US)

(73) Assignee: Sigray, Inc., Concord, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/866,953

(22) Filed: May 5, 2020

(65) Prior Publication Data

US 2020/0350138 A1 Nov. 5, 2020

Related U.S. Application Data

(63) Continuation of application No. 16/518,713, filed on Jul. 22, 2019, now Pat. No. 10,658,145.
(Continued)

(51) Int. Cl.
*H01J 35/00* (2006.01)
*H01J 35/12* (2006.01)
(Continued)

(52) U.S. Cl.
CPC ..... *H01J 35/12* (2013.01); *H01J 35/147* (2019.05); *H01J 35/153* (2019.05); *H01J 35/30* (2013.01);
(Continued)

(58) Field of Classification Search
CPC ..... H01J 2235/086; H01J 2235/081
See application file for complete search history.

(56) References Cited

U.S. PATENT DOCUMENTS 1,203,495 A 10/1916 Coolidge
1,211,092 A 1/1917 Coolidge
(Continued)

FOREIGN PATENT DOCUMENTS

CN 101257851 B 9/2008
CN 101532969 B 9/2009
(Continued)

OTHER PUBLICATIONS

"Diamond," Section 10.4.2 of Zorman et al., "Material Aspects of Micro-Nanoelectromechanical Systems," Chapter 10 of Springer Handbook of Nanotechnology, 2nd ed., Bharat Bhushan, ed. (Springer Science+ Business Media, Inc., New York, 2007), pp. 312-314.
(Continued)

*Primary Examiner* — Dani Fox
(74) *Attorney, Agent, or Firm* — Knobbe, Martens, Olson & Bear, LLP

(57) ABSTRACT

An x-ray target, x-ray source, and x-ray system are provided. The x-ray target includes a thermally conductive substrate comprising a surface and at least one structure on or embedded in at least a portion of the surface. The at least one structure includes a thermally conductive first material in thermal communication with the substrate. The first material has a length along a first direction parallel to the portion of the surface in a range greater than 1 millimeter and a width along a second direction parallel to the portion of the surface and perpendicular to the first direction. The width is in a range of 0.2 millimeter to 3 millimeters. The at least one structure further includes at least one layer over the first material. The at least one layer includes at least one second material different from the first material. The at least one layer has a thickness in a range of 2 microns to 50 microns. The at least one second material is configured to generate x-rays upon irradiation by electrons.

22 Claims, 17 Drawing Sheets

Related U.S. Application Data

(60) Provisional application No. 62/703,836, filed on Jul. 26, 2018.

(51) Int. Cl.
*H01J 35/30* (2006.01)
*H01J 35/14* (2006.01)

(52) U.S. Cl.
CPC ... *H01J 2235/081* (2013.01); *H01J 2235/088* (2013.01); *H01J 2235/1204* (2013.01)

(56) References Cited

U.S. PATENT DOCUMENTS 1,215,116 A 2/1917 Coolidge
1,328,495 A 1/1920 Coolidge
1,355,126 A 10/1920 Coolidge
1,790,073 A 1/1931 Pohl
1,917,099 A 7/1933 Coolidge
1,946,312 A 2/1934 Coolidge
2,926,270 A 2/1960 Zunick
3,795,832 A 3/1974 Holland
4,165,472 A 8/1979 Witty
4,192,994 A 3/1980 Kastner
4,227,112 A 10/1980 Waugh et al.
4,266,138 A 5/1981 Nelson et al.
4,426,718 A 1/1984 Hayashi
4,523,327 A 6/1985 Eversole
4,573,186 A 2/1986 Reinhold
4,642,811 A 2/1987 Georgopoulos
4,727,000 A 2/1988 Ovshinsky
4,798,446 A 1/1989 Hettrick
4,807,268 A 2/1989 Wittrey
4,940,319 A 7/1990 Ueda et al.
4,945,552 A 7/1990 Ueda
4,951,304 A 8/1990 Piestrup et al.
4,972,449 A 11/1990 Upadhya et al.
5,001,737 A 3/1991 Lewis et al.
5,008,918 A 4/1991 Lee et al.
5,119,408 A 6/1992 Little
5,132,997 A 7/1992 Kojima
5,148,462 A 9/1992 Spitsyn et al.
5,173,928 A 12/1992 Momose et al.
5,204,887 A 4/1993 Hayashida et al.
5,249,216 A 9/1993 Ohsugi et al.
5,276,724 A 1/1994 Kumasaka et al.
5,371,774 A 12/1994 Cerrina
5,452,142 A 9/1995 Hall
5,461,657 A 10/1995 Hayashida
5,513,237 A 4/1996 Nobuta et al.
5,602,899 A 2/1997 Larson
5,604,782 A 2/1997 Cash, Jr.
5,629,969 A 5/1997 Koshishiba
5,657,365 A 8/1997 Yamamoto et al.
5,682,415 A 10/1997 O'Hara
5,715,291 A 2/1998 Momose
5,729,583 A 3/1998 Tang et al.
5,737,387 A 4/1998 Smither
5,768,339 A 6/1998 O'Hara
5,772,903 A 6/1998 Hirsch
5,778,039 A 7/1998 Hossain
5,799,056 A 8/1998 Gutman
5,812,629 A 9/1998 Clauser
5,825,848 A 10/1998 Virshup et al.
5,832,052 A 11/1998 Hirose et al.
5,857,008 A 1/1999 Reinhold
5,878,110 A 3/1999 Yamamoto et al.
5,881,126 A 3/1999 Momose
5,912,940 A 6/1999 O'Hara
5,930,325 A 7/1999 Momose
6,108,397 A 8/2000 Cash, Jr.
6,108,398 A 8/2000 Mazor et al.
6,118,853 A 9/2000 Hansen et al.
6,125,167 A 9/2000 Morgan
6,181,773 B1 1/2001 Lee et al.
6,195,410 B1 2/2001 Cash, Jr.
6,226,347 B1 5/2001 Golenhofen
6,278,764 B1 8/2001 Barbee, Jr. et al.
6,307,916 B1 10/2001 Rogers et al.
6,359,964 B1 3/2002 Kogan
6,377,660 B1 4/2002 Ukita et al.
6,381,303 B1 4/2002 Vu et al.
6,389,100 B1 5/2002 Verman et al.
6,430,254 B2 8/2002 Wilkins
6,430,260 B1 8/2002 Snyder
6,442,231 B1 8/2002 O'Hara
6,456,688 B1 9/2002 Taguchi et al.
6,463,123 B1 10/2002 Korenev
6,487,272 B1 11/2002 Kutsuzawa
6,504,901 B1 1/2003 Loxley et al.
6,504,902 B2 1/2003 Iwasaki et al.
6,507,388 B2 1/2003 Burghoorn
6,553,096 B1 4/2003 Zhou et al.
6,560,313 B1 5/2003 Harding et al.
6,560,315 B1 5/2003 Price et al.
6,707,883 B1 3/2004 Tiearney et al.
6,711,234 B1 3/2004 Loxley et al.
6,763,086 B2 7/2004 Platonov
6,811,612 B2 11/2004 Gruen et al.
6,815,363 B2 11/2004 Yun et al.
6,829,327 B1 12/2004 Chen
6,847,699 B2 1/2005 Rigali et al.
6,850,598 B1 2/2005 Fryda et al.
6,870,172 B1 3/2005 Mankos et al.
6,885,503 B2 4/2005 Yun et al.
6,891,627 B1 5/2005 Levy et al.
6,914,723 B2 7/2005 Yun et al.
6,917,472 B1 7/2005 Yun et al.
6,934,359 B2 8/2005 Chen
6,947,522 B2 9/2005 Wilson et al.
6,975,703 B2 12/2005 Wilson et al.
7,003,077 B2 2/2006 Jen et al.
7,006,596 B1 2/2006 Janik
7,015,467 B2 3/2006 Maldonado et al.
7,023,950 B1 4/2006 Annis
7,023,955 B2 4/2006 Chen et al.
7,057,187 B1 6/2006 Yun et al.
7,076,026 B2 6/2006 Verman et al.
7,079,625 B2 7/2006 Lenz
7,095,822 B1 8/2006 Yun
7,103,138 B2 9/2006 Pelc et al.
7,110,503 B1 9/2006 Kumakhov
7,119,953 B2 10/2006 Yun et al.
7,120,228 B2 10/2006 Yokhin et al.
7,130,375 B1 10/2006 Yun et al.
7,149,283 B2 12/2006 Hoheisel et al.
7,170,969 B1 1/2007 Yun et al.
7,180,979 B2 2/2007 Momose
7,180,981 B2 2/2007 Wang
7,183,547 B2 2/2007 Yun et al.
7,215,736 B1 5/2007 Wang et al.
7,215,741 B2 5/2007 Ukita et al.
7,218,700 B2 5/2007 Huber et al.
7,218,703 B2 5/2007 Yada et al.
7,221,731 B2 5/2007 Yada et al.
7,245,696 B2 7/2007 Yun et al.
7,264,397 B2 9/2007 Ritter
7,268,945 B2 9/2007 Yun et al.
7,286,640 B2 10/2007 Yun et al.
7,297,959 B2 11/2007 Yun et al.
7,298,826 B2 11/2007 Inazuru
7,330,533 B2 2/2008 Sampayon
7,346,148 B2 3/2008 Ukita
7,346,204 B2 3/2008 Ito
7,349,525 B2 3/2008 Morton
7,359,487 B1 4/2008 Newcome
7,365,909 B2 4/2008 Yun et al.
7,365,918 B1 4/2008 Yun et al.
7,382,864 B2 6/2008 Hebert et al.
7,388,942 B2 6/2008 Wang et al.
7,394,890 B1 7/2008 Wang et al.
7,400,704 B1 7/2008 Yun et al.
7,406,151 B1 7/2008 Yun
7,412,024 B1 8/2008 Yun et al.

(56) References Cited

U.S. PATENT DOCUMENTS 7,412,030 B1 8/2008 O'Hara
7,412,131 B2 8/2008 Lee et al.
7,414,787 B2 8/2008 Yun et al.
7,433,444 B2 10/2008 Baumann
7,440,542 B2 10/2008 Baumann
7,443,953 B1 10/2008 Yun et al.
7,443,958 B2 10/2008 Harding
7,453,981 B2 11/2008 Baumann
7,463,712 B2 12/2008 Zhu et al.
7,474,735 B2 1/2009 Spahn
7,486,770 B2 2/2009 Baumann
7,492,871 B2 2/2009 Popescu
7,499,521 B2 3/2009 Wang et al.
7,515,684 B2 4/2009 Gibson et al.
7,522,698 B2 4/2009 Popescu
7,522,707 B2 4/2009 Steinlage et al.
7,522,708 B2 4/2009 Heismann
7,529,343 B2 5/2009 Safai et al.
7,532,704 B2 5/2009 Hempel
7,551,719 B2 6/2009 Yokhin et al.
7,551,722 B2 6/2009 Ohshima et al.
7,561,662 B2 7/2009 Wang et al.
7,564,941 B2 7/2009 Baumann
7,583,789 B1 9/2009 Macdonald et al.
7,601,399 B2 10/2009 Barnola et al.
7,605,371 B2 10/2009 Yasui et al.
7,639,786 B2 12/2009 Baumann
7,646,843 B2 1/2010 Popescu et al.
7,653,177 B2 1/2010 Baumann et al.
7,672,433 B2 3/2010 Zhong et al.
7,680,243 B2 3/2010 Yokhin et al.
7,738,629 B2 6/2010 Chen
7,787,588 B1 8/2010 Yun et al.
7,796,725 B1 9/2010 Yun et al.
7,796,726 B1 9/2010 Gendreau et al.
7,800,072 B2 9/2010 Yun et al.
7,809,113 B2 10/2010 Aoki et al.
7,813,475 B1 10/2010 Wu et al.
7,817,777 B2 10/2010 Baumann et al.
7,848,483 B2 12/2010 Platonov
7,864,426 B2 1/2011 Yun et al.
7,864,922 B2 1/2011 Kawabe
7,873,146 B2 1/2011 Okunuki et al.
7,876,883 B2 1/2011 O'Hara
7,889,838 B2 2/2011 David et al.
7,889,844 B2 2/2011 Okunuki et al.
7,899,154 B2 3/2011 Chen et al.
7,902,528 B2 3/2011 Hara et al.
7,914,693 B2 3/2011 Jeong et al.
7,920,673 B2 4/2011 Lanza et al.
7,920,676 B2 4/2011 Yun et al.
7,924,973 B2 4/2011 Kottler et al.
7,929,667 B1 4/2011 Zhuang et al.
7,945,018 B2 5/2011 Heismann
7,949,092 B2 5/2011 Brons
7,949,095 B2 5/2011 Ning
7,974,379 B1 7/2011 Case et al.
7,983,381 B2 7/2011 David et al.
7,991,120 B2 8/2011 Okunuki et al.
8,005,185 B2 8/2011 Popescu
8,009,796 B2 8/2011 Popescu
8,009,797 B2 8/2011 Ouchi
8,041,004 B2 10/2011 David
8,036,341 B2 11/2011 Lee
8,058,621 B2 11/2011 Kommareddy
8,068,579 B1 11/2011 Yun et al.
8,073,099 B2 12/2011 Niu et al.
8,094,784 B2 1/2012 Morton
8,139,711 B2 3/2012 Takahashi
8,139,716 B2 3/2012 Okunuki et al.
8,165,270 B2 4/2012 David et al.
8,184,771 B2 5/2012 Murakoshi
8,208,602 B2 6/2012 Lee
8,208,603 B2 6/2012 Sato
8,233,587 B2 7/2012 Sato
8,243,879 B2 8/2012 Itoh et al.
8,243,884 B2 8/2012 Rödhammer et al.
8,249,220 B2 8/2012 Verman et al.
8,280,000 B2 10/2012 Takahashi
8,306,183 B2 11/2012 Koehler
8,306,184 B2 11/2012 Chang et al.
8,331,534 B2 12/2012 Silver
8,351,569 B2 1/2013 Baker
8,351,570 B2 1/2013 Nakamura
8,353,628 B1 1/2013 Yun et al.
8,357,894 B2 1/2013 Toth et al.
8,360,640 B2 1/2013 Reinhold
8,374,309 B2 2/2013 Donath
8,406,378 B2 3/2013 Wang et al.
8,416,920 B2 4/2013 Okumura et al.
8,422,633 B2 4/2013 Lantz et al.
8,423,127 B2 4/2013 Mahmood et al.
8,451,975 B2 5/2013 Tada
8,422,637 B2 6/2013 Okunuki et al.
8,488,743 B2 7/2013 Verman
8,509,386 B2 8/2013 Lee et al.
8,520,803 B2 8/2013 Behling
8,526,575 B1 9/2013 Yun et al.
8,532,257 B2 9/2013 Mukaide et al.
8,553,843 B2 10/2013 Drory
8,559,594 B2 10/2013 Ouchi
8,559,597 B2 10/2013 Chen et al.
8,565,371 B2 10/2013 Bredno
8,576,983 B2 11/2013 Baeumer
8,588,372 B2 11/2013 Zou et al.
8,591,108 B2 11/2013 Tada
8,602,648 B1 12/2013 Jacobsen et al.
8,632,247 B2 1/2014 Ishii
8,644,451 B2 2/2014 Aoki et al.
8,666,024 B2 3/2014 Okunuki et al.
8,666,025 B2 3/2014 Klausz
8,699,667 B2 4/2014 Steinlage et al.
8,735,844 B1 5/2014 Khaykovich et al.
8,737,565 B1 5/2014 Lyon et al.
8,744,048 B2 6/2014 Lee et al.
8,755,487 B2 6/2014 Kaneko
8,767,915 B2 7/2014 Stutman
8,767,916 B2 7/2014 Hashimoto
8,781,069 B2 7/2014 Murakoshi
8,824,629 B2 9/2014 Ishii
8,831,174 B2 9/2014 Kohara
8,831,175 B2 9/2014 Silver et al.
8,831,179 B2 9/2014 Adler et al.
8,837,680 B2 9/2014 Tsujii
8,855,265 B2 10/2014 Engel
8,859,977 B2 10/2014 Kondoh
8,861,682 B2 10/2014 Okunuki et al.
8,903,042 B2 12/2014 Ishii
8,908,824 B2 12/2014 Kondoh
8,972,191 B2 3/2015 Stampanoni et al.
8,989,351 B2 3/2015 Vogtmeier et al.
8,989,474 B2 3/2015 Kido et al.
8,995,622 B2 3/2015 Adler et al.
9,001,967 B2 4/2015 Baturin
9,001,968 B2 4/2015 Kugland et al.
9,007,562 B2 4/2015 Marconi et al.
9,008,278 B2 4/2015 Lee et al.
9,016,943 B2 4/2015 Jacobsen et al.
9,020,101 B2 4/2015 Omote et al.
9,025,725 B2 5/2015 Kiyohara et al.
9,029,795 B2 5/2015 Sando
9,031,201 B2 5/2015 Sato
9,036,773 B2 5/2015 David et al.
9,063,055 B2 6/2015 Ouchi
9,086,536 B2 7/2015 Pang et al.
9,129,715 B2 9/2015 Adler et al.
9,222,899 B2 12/2015 Yamaguchi
9,230,703 B2 1/2016 Mohr et al.
9,234,856 B2 1/2016 Mukaide
9,251,995 B2 2/2016 Ogura
9,257,254 B2 2/2016 Ogura et al.
9,263,225 B2 2/2016 Morton
9,280,056 B2 3/2016 Clube et al.
9,281,158 B2 3/2016 Ogura

(56) References Cited

U.S. PATENT DOCUMENTS 9,291,578 B2 3/2016 Adler
9,329,141 B2 5/2016 Stutman
9,336,917 B2 5/2016 Ozawa et al.
9,357,975 B2 6/2016 Baturin
9,362,081 B2 6/2016 Bleuet
9,370,084 B2 6/2016 Sprong et al.
9,390,881 B2 7/2016 Yun et al.
9,412,552 B2 8/2016 Aoki et al.
9,430,832 B2 8/2016 Koehler et al.
9,439,613 B2 9/2016 Stutman
9,445,775 B2 9/2016 Das
9,448,190 B2 9/2016 Yun et al.
9,449,780 B2 9/2016 Chen
9,449,781 B2 9/2016 Yun et al.
9,453,803 B2 9/2016 Radicke
9,480,447 B2 11/2016 Mohr et al.
9,486,175 B2 11/2016 Fredenberg et al.
9,494,534 B2 11/2016 Baturin
9,502,204 B2 11/2016 Ikarashi
9,520,260 B2 12/2016 Hesselink et al.
9,524,846 B2 12/2016 Sato et al.
9,532,760 B2 1/2017 Anton et al.
9,543,109 B2 1/2017 Yun et al.
9,557,280 B2 1/2017 Pfeiffer et al.
9,564,284 B2 2/2017 Gerzoskovitz
9,570,264 B2 2/2017 Ogura et al.
9,570,265 B1 2/2017 Yun et al.
9,588,066 B2 3/2017 Pois et al.
9,594,036 B2 3/2017 Yun et al.
9,595,415 B2 3/2017 Ogura
9,632,040 B2 4/2017 Stutman
9,658,174 B2 5/2017 Omote
9,700,267 B2 7/2017 Baturin et al.
9,719,947 B2 8/2017 Yun et al.
9,748,012 B2 8/2017 Yokoyama
9,757,081 B2 9/2017 Proksa
9,761,021 B2 9/2017 Koehler
9,770,215 B2 9/2017 Souchay et al.
9,823,203 B2 11/2017 Yun et al.
9,826,949 B2 11/2017 Ning
9,837,178 B2 12/2017 Nagai
9,842,414 B2 12/2017 Koehler
9,861,330 B2 1/2018 Rossl
9,874,531 B2 1/2018 Yun et al.
9,881,710 B2 1/2018 Roessl
9,916,655 B2 3/2018 Sampanoni
9,934,930 B2 4/2018 Parker et al.
9,939,392 B2 4/2018 Wen
9,970,119 B2 5/2018 Yokoyama
10,014,148 B2 7/2018 Tang et al.
10,020,158 B2 7/2018 Yamada
10,028,716 B2 7/2018 Rossl
10,045,753 B2 8/2018 Teshima
10,068,740 B2 9/2018 Gupta
10,074,451 B2 9/2018 Kottler et al.
10,076,297 B2 9/2018 Bauer
10,085,701 B2 10/2018 Hoshino
10,105,112 B2 10/2018 Utsumi
10,115,557 B2 10/2018 Ishii
10,141,081 B2 11/2018 Preusche
10,151,713 B2 12/2018 Wu et al.
10,153,061 B2 12/2018 Yokoyama
10,153,062 B2 12/2018 Gall et al.
10,182,194 B2 1/2019 Karim et al.
10,217,596 B2 2/2019 Liang et al.
10,231,687 B2 3/2019 Kahn et al.
10,247,683 B2 4/2019 Yun et al.
10,256,001 B2 4/2019 Yokoyama
10,264,659 B1 4/2019 Miller et al.
10,267,752 B2 4/2019 Zhang et al.
10,267,753 B2 4/2019 Zhang et al.
10,269,528 B2 4/2019 Yun et al.
10,295,485 B2 5/2019 Yun et al.
10,295,486 B2 5/2019 Yun et al.
10,297,359 B2 5/2019 Yun et al.
10,304,580 B2 5/2019 Yun et al.
10,349,908 B2 7/2019 Yun et al.
10,352,695 B2 7/2019 Dziura et al.
10,352,880 B2 7/2019 Yun et al.
10,393,683 B2 8/2019 Hegeman et al.
10,401,309 B2 9/2019 Yun et al.
10,416,099 B2 9/2019 Yun et al.
10,429,325 B2 10/2019 Ito et al.
10,466,185 B2 11/2019 Yun et al.
10,485,492 B2 11/2019 Koehler et al.
10,568,588 B2 2/2020 Koehler et al.
10,653,376 B2 5/2020 Yun et al.
10,697,902 B2 6/2020 Sharma et al.
10,841,515 B1 11/2020 Tsujino
2001/0006413 A1 7/2001 Burghoorn
2002/0080916 A1 6/2002 Jiang
2002/0085676 A1 7/2002 Snyder
2003/0142790 A1 1/2003 Zhou et al.
2003/0054133 A1 3/2003 Wadley et al.
2003/0112923 A1 6/2003 Lange
2003/0142781 A1 7/2003 Kawahara
2003/0223536 A1 12/2003 Yun et al.
2004/0047446 A1 3/2004 Platonov
2004/0076260 A1 4/2004 Charles, Jr.
2004/0120463 A1 6/2004 Wilson et al.
2004/0140432 A1 7/2004 Maldonado et al.
2005/0025281 A1 2/2005 Verman et al.
2005/0074094 A1 4/2005 Jen et al.
2005/0123097 A1 6/2005 Wang
2005/0163284 A1 7/2005 Inazuru
2005/0201520 A1 9/2005 Smith et al.
2005/0282300 A1 12/2005 Yun et al.
2006/0045234 A1 3/2006 Pelc
2006/0062350 A1 3/2006 Yokhin
2006/0182322 A1 8/2006 Bernhardt et al.
2006/0233309 A1 10/2006 Kutzner et al.
2006/0239405 A1 10/2006 Verman
2007/0030959 A1 2/2007 Ritter
2007/0071174 A1 3/2007 Hebert et al.
2007/0108387 A1 5/2007 Yun et al.
2007/0110217 A1 5/2007 Ukita
2007/0183563 A1 8/2007 Baumann
2007/0183579 A1 8/2007 Baumann et al.
2007/0189449 A1 8/2007 Baumann
2007/0248215 A1 10/2007 Ohshima et al.
2008/0084966 A1 4/2008 Aoki et al.
2008/0089484 A1 4/2008 Reinhold
2008/0094694 A1 4/2008 Yun et al.
2008/0099935 A1 5/2008 Egle
2008/0116398 A1 5/2008 Hara
2008/0117511 A1 5/2008 Chen
2008/0159475 A1 7/2008 Mazor et al.
2008/0159707 A1 7/2008 Lee et al.
2008/0165355 A1 7/2008 Yasui et al.
2008/0170662 A1 7/2008 Reinhold
2008/0170668 A1 7/2008 Kruit et al.
2008/0181363 A1 7/2008 Fenter et al.
2008/0240344 A1 10/2008 Reinhold
2008/0273662 A1 11/2008 Yun
2009/0052619 A1 2/2009 Endoh
2009/0092227 A1 4/2009 David
2009/0154640 A1 6/2009 Baumann et al.
2009/0316857 A1 12/2009 David et al.
2009/0316860 A1 12/2009 Okunuki et al.
2010/0012845 A1 1/2010 Baeumer et al.
2010/0027739 A1 2/2010 Lantz et al.
2010/0040202 A1 2/2010 Lee
2010/0046702 A1 2/2010 Chen et al.
2010/0061508 A1 3/2010 Takahashi
2010/0091947 A1 4/2010 Niu
2010/0141151 A1 6/2010 Reinhold
2010/0246765 A1 9/2010 Murakoshi
2010/0260315 A1 10/2010 Sato et al.
2010/0272239 A1 10/2010 Lantz et al.
2010/0284513 A1 11/2010 Kawabe
2011/0026680 A1 2/2011 Sato
2011/0038455 A1 2/2011 Silver et al.
2011/0058655 A1 3/2011 Okumura et al.
2011/0064191 A1 3/2011 Toth et al.

(56) References Cited

U.S. PATENT DOCUMENTS

2011/0064202 A1 3/2011 Thran et al.
2011/0085644 A1 4/2011 Verman
2011/0135066 A1 6/2011 Behling
2011/0142204 A1 6/2011 Zou et al.
2011/0235781 A1 9/2011 Aoki et al.
2011/0243302 A1 10/2011 Murakoshi
2011/0268252 A1 11/2011 Ozawa et al.
2012/0041679 A1 2/2012 Stampanoni
2012/0057669 A1 3/2012 Vogtmeier et al.
2012/0163547 A1 6/2012 Lee et al.
2012/0163554 A1 6/2012 Tada
2012/0224670 A1 9/2012 Kiyohara et al.
2012/0228475 A1 9/2012 Pang et al.
2012/0269323 A1 10/2012 Adler et al.
2012/0269324 A1 10/2012 Adler
2012/0269325 A1 10/2012 Adler et al.
2012/0269326 A1 10/2012 Adler et al.
2012/0294420 A1 11/2012 Nagai
2013/0011040 A1 1/2013 Kido et al.
2013/0032727 A1 2/2013 Kondoe
2013/0039460 A1 2/2013 Levy
2013/0108012 A1 5/2013 Sato
2013/0108022 A1 5/2013 Kugland et al.
2013/0195246 A1 8/2013 Tamura et al.
2013/0223594 A1 8/2013 Sprong et al.
2013/0235976 A1 9/2013 Jeong et al.
2013/0251100 A1 9/2013 Sasaki et al.
2013/0259207 A1 10/2013 Omote et al.
2013/0279651 A1 10/2013 Yokoyama
2013/0308112 A1 11/2013 Clube et al.
2013/0308754 A1 11/2013 Yamazaki et al.
2014/0023973 A1 1/2014 Marconi et al.
2014/0029729 A1 1/2014 Kucharczyk
2014/0037052 A1 2/2014 Adler
2014/0064445 A1 3/2014 Adler
2014/0072104 A1 3/2014 Jacobsen et al.
2014/0079188 A1 3/2014 Hesselink et al.
2014/0105353 A1 4/2014 Pfeiffer et al.
2014/0105363 A1 4/2014 Chen et al.
2014/0146945 A1 5/2014 Fredenberg et al.
2014/0153692 A1 6/2014 Larkin et al.
2014/0177800 A1 6/2014 Sato et al.
2014/0185778 A1 7/2014 Lee et al.
2014/0205057 A1 7/2014 Koehler et al.
2014/0211919 A1 7/2014 Ogura et al.
2014/0226785 A1 8/2014 Stutman et al.
2014/0241493 A1 8/2014 Yokoyama
2014/0270060 A1 9/2014 Date et al.
2014/0369469 A1 12/2014 Ogura et al.
2014/0369471 A1* 12/2014 Ogura ..... H01J 35/08 378/62
2015/0030126 A1 1/2015 Radicke
2015/0030127 A1 1/2015 Aoki et al.
2015/0043713 A1 2/2015 Chen
2015/0049860 A1 2/2015 Das
2015/0051877 A1 2/2015 Bakerman et al.
2015/0055743 A1 2/2015 Vedantham et al.
2015/0055745 A1 2/2015 Holzner et al.
2015/0071402 A1 3/2015 Handa
2015/0092924 A1 4/2015 Yun et al.
2015/0110252 A1 4/2015 Yun et al.
2015/0117599 A1 4/2015 Yun et al.
2015/0194287 A1 7/2015 Yun et al.
2015/0243397 A1 8/2015 Yun et al.
2015/0247811 A1 9/2015 Yun et al.
2015/0260663 A1 9/2015 Yun et al.
2015/0323478 A1 11/2015 Stutman
2015/0357069 A1 12/2015 Yun et al.
2016/0064175 A1 3/2016 Yun et al.
2016/0066870 A1 3/2016 Yun et al.
2016/0106387 A1 4/2016 Kahn
2016/0178540 A1 6/2016 Yun et al.
2016/0178541 A1 6/2016 Hwang et al.
2016/0206259 A1 7/2016 Auclair et al.
2016/0268094 A1 9/2016 Yun et al.
2016/0320320 A1 11/2016 Yun et al.
2016/0351370 A1 12/2016 Yun et al.
2017/0018392 A1 1/2017 Cheng
2017/0047191 A1 2/2017 Yun et al.
2017/0052128 A1 2/2017 Yun et al.
2017/0074809 A1 3/2017 Ito
2017/0162288 A1 6/2017 Yun et al.
2017/0162359 A1 6/2017 Tang et al.
2017/0227476 A1 8/2017 Zhang et al.
2017/0234811 A1 8/2017 Zhang et al.
2017/0261442 A1 9/2017 Yun et al.
2017/0336334 A1 11/2017 Yun et al.
2018/0144901 A1 5/2018 Yun et al.
2018/0182131 A1 6/2018 Koehler et al.
2018/0202951 A1 7/2018 Yun et al.
2018/0261352 A1 9/2018 Matsuyama et al.
2018/0306734 A1 10/2018 Morimoto et al.
2018/0323032 A1 11/2018 Strelec et al.
2018/0344276 A1 12/2018 DeFreitas et al.
2018/0348151 A1 12/2018 Kasper et al.
2018/0356355 A1 12/2018 Momose et al.
2019/0017942 A1 1/2019 Filevich
2019/0017946 A1 1/2019 Wack et al.
2019/0018824 A1 1/2019 Zarkadas
2019/0019647 A1 1/2019 Lee et al.
2019/0027265 A1 1/2019 Dey et al.
2019/0043689 A1 2/2019 Camus
2019/0057832 A1 2/2019 Durst et al.
2019/0064084 A1 2/2019 Ullom et al.
2019/0086342 A1 3/2019 Pois et al.
2019/0088439 A1 3/2019 Honda
2019/0113466 A1 4/2019 Karim et al.
2019/0115184 A1 4/2019 Zalubovsky
2019/0131103 A1 5/2019 Tuohimaa
2019/0132936 A1 5/2019 Steck et al.
2019/0154892 A1 5/2019 Moldovan
2019/0172681 A1 6/2019 Owen et al.
2019/0189385 A1 6/2019 Liang et al.
2019/0204246 A1 7/2019 Hegeman et al.
2019/0204757 A1 7/2019 Brussard et al.
2019/0206652 A1 7/2019 Akinwande et al.
2019/0212281 A1 7/2019 Shchgegrov
2019/0214216 A1 7/2019 Jeong et al.
2019/0216416 A1 7/2019 Koehler et al.
2019/0219713 A1 7/2019 Booker et al.
2019/0261935 A1 8/2019 Kitamura
2019/0272929 A1 9/2019 Omote et al.
2019/0304735 A1 10/2019 Safai et al.
2019/0311874 A1 10/2019 Tuohimma et al.
2019/0317027 A1 10/2019 Tsuboi et al.
2019/0331616 A1 10/2019 Schaff et al.
2019/0341219 A1 11/2019 Zhang et al.
2019/0341220 A1 11/2019 Parker et al.
2019/0353802 A1 11/2019 Steinhauser et al.
2019/0374182 A1 12/2019 Karim et al.
2019/0380193 A1 12/2019 Matsuhana et al.
2019/0387602 A1 12/2019 Woywode et al.
2019/0391087 A1 12/2019 Matejka et al.
2020/0003708 A1 1/2020 Kobayashi et al.
2020/0003712 A1 1/2020 Kataoka et al.
2020/0041429 A1 2/2020 Cho et al.
2020/0058462 A1 2/2020 Suzuki
2020/0088656 A1 3/2020 Pois et al.
2020/0090826 A1 3/2020 Adler
2020/0103358 A1 4/2020 Wiell et al.
2020/0105492 A1 4/2020 Behling et al.
2020/0154552 A1 5/2020 Suzuki et al.
2020/0155088 A1 5/2020 Gruener et al.
2020/0158662 A1 5/2020 Horiba et al.
2020/0163195 A1 5/2020 Steck et al.
2020/0168427 A1 5/2020 Krokhmal et al.
2020/0182806 A1 6/2020 Kappler et al.
2020/0187339 A1 6/2020 Freudenberger et al.
2020/0191732 A1 6/2020 Taniguchi et al.
2020/0194212 A1 6/2020 Dalakos et al.
2020/0203113 A1 6/2020 Ponard
2020/0225172 A1 7/2020 Sato et al.
2020/0225173 A1 7/2020 Sato et al.
2020/0225371 A1 7/2020 Greenberg et al.

(56) References Cited

U.S. PATENT DOCUMENTS

| | | | |
|---|---|---|---|
| 2020/0232937 | A1 | 7/2020 | Yaroshenko et al. |
| 2020/0234908 | A1 | 7/2020 | Fishman et al. |
| 2020/0279351 | A1 | 9/2020 | Ratner et al. |
| 2020/0292475 | A1 | 9/2020 | Cao et al. |
| 2020/0297297 | A1 | 9/2020 | Kok et al. |
| 2020/0300789 | A1 | 9/2020 | Osakabe et al. |
| 2020/0300790 | A1 | 9/2020 | Gellineau et al. |
| 2020/0303265 | A1 | 9/2020 | Gellineau et al. |
| 2020/0305809 | A1 | 10/2020 | Schwoebel et al. |
| 2020/0319120 | A1 | 10/2020 | Kitamura et al. |
| 2020/0321184 | A1 | 10/2020 | Parker et al. |
| 2020/0330059 | A1 | 10/2020 | Fredenberg et al. |
| 2020/0337659 | A1 | 10/2020 | Sano et al. |
| 2020/0378904 | A1 | 12/2020 | Albarqouni et al. |
| 2020/0378905 | A1 | 12/2020 | Safai |
| 2020/0378907 | A1 | 12/2020 | Morton |
| 2020/0378908 | A1 | 12/2020 | Fujimura et al. |
| 2020/0388461 | A1 | 12/2020 | Behling et al. |

FOREIGN PATENT DOCUMENTS

| | | | |
|---|---|---|---|
| CN | 1015329696 | B | 9/2009 |
| CN | 102124537 | A | 7/2011 |
| CN | 102325498 | B | 1/2012 |
| CN | 102551761 | A | 7/2012 |
| EP | 0432568 | | 6/1991 |
| EP | 0751533 | | 1/1997 |
| EP | 1028451 | | 8/2000 |
| EP | 1169713 | A2 | 1/2006 |
| EP | 3093867 | A1 | 11/2016 |
| FR | 2548447 | A1 | 1/1985 |
| JP | H06-188092 | | 7/1994 |
| JP | H07-056000 | | 3/1995 |
| JP | H07-194592 | | 8/1995 |
| JP | H08-128971 | | 7/1996 |
| JP | H11-304728 | | 11/1999 |
| JP | H11-352079 | | 12/1999 |
| JP | 2000-306533 | A | 11/2000 |
| JP | 2001-021507 | | 1/2001 |
| JP | 2003-149392 | | 5/2003 |
| JP | 2003-288853 | | 10/2003 |
| JP | 2004-089445 | | 3/2004 |
| JP | 2004-518262 | | 6/2004 |
| JP | 2007-218683 | | 8/2007 |
| JP | 2007-265981 | | 10/2007 |
| JP | 2007-311185 | | 11/2007 |
| JP | 2008-200359 | | 4/2008 |
| JP | 2008-145111 | | 6/2008 |
| JP | 2008-197495 | | 8/2008 |
| JP | 2009-195349 | | 3/2009 |
| JP | 2009-212058 | | 9/2009 |
| JP | 2010-236986 | | 10/2010 |
| JP | 2011-029072 | | 2/2011 |
| JP | 2011-033537 | | 2/2011 |
| JP | 2011-218147 | | 11/2011 |
| JP | 2012-032387 | | 2/2012 |
| JP | 2012-187341 | | 10/2012 |
| JP | 2012-254294 | | 12/2012 |
| JP | 2013-508683 | | 3/2013 |
| JP | 2015-529984 | | 7/2013 |
| JP | 2013-157269 | | 8/2013 |
| JP | 2013-160637 | | 8/2013 |
| JP | 2013-181811 | | 9/2013 |
| JP | 2013-239317 | | 11/2013 |
| JP | 2015-002074 | | 1/2015 |
| JP | 2015-047306 | | 3/2015 |
| JP | 2015-072263 | | 4/2015 |
| JP | 2015-077289 | | 4/2015 |
| JP | 2017-040618 | | 2/2017 |
| KR | 10-2012-0091591 | A | 8/2012 |
| KR | 10-2014-0059688 | A | 5/2014 |
| WO | WO 1995/006952 | | 3/1995 |
| WO | WO 1998/011592 | | 3/1998 |
| WO | WO 2002/039792 | | 5/2002 |
| WO | WO 2003/081631 | | 10/2003 |
| WO | WO 2005/109969 | | 11/2005 |
| WO | WO 2006/096052 | | 9/2006 |
| WO | WO 2007/125833 | | 11/2007 |
| WO | WO 2008/068044 | | 6/2008 |
| WO | WO 2009/098027 | | 8/2009 |
| WO | WO 2009/104560 | | 8/2009 |
| WO | WO 2010/109909 | | 9/2010 |
| WO | WO 2011/032572 | | 3/2011 |
| WO | WO 2012/032950 | | 3/2012 |
| WO | WO 2013/004574 | | 1/2013 |
| WO | WO 2013/111050 | A1 | 8/2013 |
| WO | WO 2013/118593 | A1 | 8/2013 |
| WO | WO 2013/160153 | A1 | 10/2013 |
| WO | WO 2013/168468 | A1 | 11/2013 |
| WO | WO 2014/054497 | A1 | 4/2014 |
| WO | WO 2015/016019 | A1 | 2/2015 |
| WO | WO 2015/034791 | A1 | 3/2015 |
| WO | WO 2015/066333 | A1 | 5/2015 |
| WO | WO 2015/084466 | A2 | 6/2015 |
| WO | WO 2015/152490 | A1 | 10/2015 |
| WO | WO 2015/168473 | A1 | 11/2015 |
| WO | WO 2015/176023 | A1 | 11/2015 |
| WO | WO 2015/187219 | A1 | 12/2015 |
| WO | WO 2016/187623 | A1 | 11/2016 |
| WO | WO 2017/031740 | A1 | 3/2017 |
| WO | WO 2017/204850 | A1 | 11/2017 |
| WO | WO 2017/213996 | A1 | 12/2017 |
| WO | WO 2018/122213 | A1 | 7/2018 |
| WO | WO 2018/175570 | | 9/2018 |

OTHER PUBLICATIONS

"Element Six CVD Diamond Handbook" (Element Six, Luxembourg, 2015).

"High performance benchtop EDXRF spectrometer with Windows®® software," published by: Rigaku Corp., Tokyo, Japan; 2017.

"Monochromatic Doubly Curved Crystal Optics," published by: X-Ray Optical Systems, Inc. (XOS), East Greenbush, NY; 2017.

"Optics and Detectors," Section 4 of X-Ray Data Booklet, 3rd Ed., A.C. Thompson ed. (Lawrence Berkeley Nat'l Lab, Berkeley, CA, 2009).

"Properties of Solids," Ch. 12 of CRC Handbook of Chemistry and Physics, 90th ed., Devid R. Lide & W.M. "Mickey" Haynes, eds. (CRC Press, Boca Raton, FL, 2009), pp. 12-41-12-46; 12-203-12-212.

"Science and Technology of Future Light Sources", Arthur L. Robinson (LBNL) and Brad Plummer (SLAG), eds. Report Nos. ANL-08/39 / BNL-81895-2008 / LBNL-1090E-2009 / SLAC-R-917 (Lawrence Berkeley Nat'l Lab, Berkeley, CA, Dec. 2008).

"Series 5000 Packaged X-ray Tubes," Product Technical Data Sheet DS006 Rev. G, X-Ray Technologies Inc. (Oxford Instruments), Scotts Valley, CA (no date).

"Toward Control of Matter: Energy Science Needs for a New Class of X-Ray Light Sources" (Lawrence Berkeley Nat'l Lab, Berkeley, CA, Sep. 2008).

"X-ray Optics for BES Light Source Facilities," Report of the Basic Energy Sciences Workshop on X-ray Optics for BES Light Source Facilities, D. Mills & H. Padmore, Co-Chairs, (U.S. Dept. of Energy, Office of Science, Potomac, MD, Mar. 2013).

Abullian et al., "Quantitative determination of the lateral density and intermolecular correlation between proteins anchored on the membrane surfaces using grazing incidence small-angle X-ray scattering and grazing incidence X-ray fluorescence," Nov. 28, 2012, The Journal of Chemical Physics, vol. 137, pp. 204907-1 to 204907-8.

Adachi et al., "Development of the 17-inch Direct-Conversion Dynamic Flat-panel X-ray Detector (FPD)," Digital R/F (Shimadzu Corp., 2 pages (no date, published—2004 with product release).

Aharonovich et al., "Diamond Nanophotonics," Adv. Op. Mat'ls vol. 2, Issue 10 (2014).

Akan et al., "Metal-Assisted Chemical Etching and Electroless Deposition for Fabrication of Hard X-ray Pd/Si Zone Plates," Micromachines, vol. 11, 301; doi:10.3390/mi11030301 (2020).

(56) References Cited

OTHER PUBLICATIONS

Als-Nielsen et al., "X-rays and their interaction with matter", and "Sources", Ch. 1 & 2 of "Elements of Modern X-ray Physics, Second Edition" (John Wiley & Sons Ltd, Chichester, West Sussex, UK, 2011).
Als-Nielsen et al., "Refraction and reflection from interfaces," Ch. 3 of "Elements of Modern X-ray Physics, Second Edition," (John Wiley & Sons Ltd., Chichester, West Sussex, UK, 2011), pp. 69-112.
Als-Nielsen et al., "Photoelectric Absorption," Ch. 7 of "Elements of Modern X-ray Physics, Second Edition," (John Wiley & Sons Ltd, Chichester, West Sussex, UK, 2011).
Als-Nielsen et al., "Phase contrast imaging" Sect. 9.3 of Ch. 9 of "Elements of Modern X-ray Physics, Second Edition" , (John Wiley & Sons Ltd, Chichester, West Sussex, UK, 2011), pp. 318-329.
Altapova et al., "Phase contrast laminography based on Talbot interferometry," Opt. Express, vol. 20, No. 6, (2012) pp. 6496-6508.
Ando et al., "Smooth and high-rate reactive ion etching of diamond," Diamond and Related Materials, vol. 11, (2002) pp. 824-827.
Arfelli et al., "Mammography with Synchrotron Radiation: Phase-Detection Techniques," Radiology vol. 215, (2000), pp. 286-293.
Arndt et al., Focusing Mirrors for Use with Microfocus X-ray Tubes, 1998, Journal of Applied Crystallography, vol. 31, pp. 733-741.
Bachucki et al., "Laboratory-based double X-ray spectrometer for simultaneous X-ray emission and X-ray absorption studies," J. Anal. Atomic Spectr. DOI:10.1039/C9JA00159J (2019).
Balaic et al., "X-ray optics of tapered capillaries," Appl. Opt. vol. 34 (Nov. 1995) pp. 7263-7272.
Baltes et al., "Coherent and incoherent grating reconstruction," J. Opt. Soc. Am. A vol. 3(8), (1986), pp. 1268-1275.
Barbee Jr., "Multilayers for x-ray optics," Opt. Eng. vol. 25 (Aug. 1986) pp. 898-915.
Baron et al., "A compact optical design for Bragg reflections near backscattering," J. Synchrotron Rad., vol. 8 (2001), pp. 1127-1130.
Bech, "X-ray imaging with a grating interferometer," University of Copenhagen PhD. Thesis, (May 1, 2009).
Bech, "In-vivo dark-field and phase-contrast x-ray imaging," Scientific Reports 3, (2013), Article No. 03209.
Behling, "Medical X-ray sources Now and for the Future," Nucl. Inst. and Methods in Physics Research A 873, pp. 43-50 (2017).
Bergamin et al., "Measuring small lattice distortions in Si-crystals by phase-contrast x-ray topography," J. Phys. D: Appl. Phys. vol. 33 (Dec. 31, 2000) pp. 2678-2682.
Bernstorff, "Grazing Incidence Small Angle X-ray Scattering (GISAXS)," Presentation at Advanced School on Synchrotron and Free Electron Laser Sources and their Multidisciplinary Applications, Apr. 2008, Trieste, Italy.
Bilderback et al., "Single Capillaries," Ch. 29 of "Handbook of Optics vol. III, 2nd Ed." (McGraw Hill, New York, 2001).
Birkholz, "Chapter 4: Grazing Incidence Configurations," Thin Film Analysis by X-ray Scattering (Wiley-VCH Verlag GmbH & Co. KGaA, Weinheim, Germany, 2006).
Bjeoumikhov et al., "A modular system for XRF and XRD applications consisting of a microfocus X-ray source and different capillary optics," X-ray Spectrometry, vol. 33 (2004), pp. 312-316.
Bjeoumikhov et al., "Capillary Optics for X-Rays," Ch. 18 of "Modern Developments in X-Ray and Neutron Optics," A. Erko et al., eds. (Springer, Berlin, Germany, 2008), pp. 287-306.
Buchanan et al., "Effective modelling of high-energy laboratory-based x-ray phase contrast imaging utilising absorption masks or gratings," J. Appl. Physics (accepted) (2020).
Canberra Model S-5005 WinAxil X-Ray Analysis Software, published by: Canberra Eurisys Benelux N.V./S.A.,Zellik, Belgium; Jun. 2004.
Cerrina, "The Schwarzschild Objective," Ch. 27 of "Handbook of Optics vol. III, 2nd Ed." (McGraw Hill, New York, 2001).
Chang et al., "Ultra-high aspect ratio high-resolution nanofabrication of hard X-ray diffractive optics," Nature Comm. 5:4243, doi: 10.1038/ncomms5243 (2014).
Chen et al., "Guiding and focusing neutron beams using capillary optics," Nature vol. 357 (Jun. 4, 1992), pp. 391-393.
Chen et al., "Advance in detection of low sulfur content by wavelength dispersive XRF," Proceedings of the Annual ISA Analysis Division Symposium (2002).
Chen et al., "Doubly curved crystal (DCC) X-ray optics and applications," Powder Diffraction, vol. 17(2) (2002), pp. 99-103.
Chervenak et al., "Experimental thick-target bremsstrahlung spectra from electrons in the range 10 to 30 keV", Phys. Rev. A vol. 12 (1975), pp. 26-33.
Chon, "Measurement of Roundness for an X-Ray Mono-Capillary Optic by Using Computed Tomography," J. Korean Phys. Soc. vol. 74, No. 9, pp. 901-906 (May 2019).
Coan et al., "In vivo x-ray phase contrast analyzer-based imaging for longitudinal osteoarthritis studies in guinea pigs," Phys. Med. Biol. vol. 55(24) (2010), pp. 7649-7662.
Cockcroft et al., "Chapter 2: Experimental Setups," Powder Diffraction: Theory and Practice, R.E. Dinnebier and S.J.L. Billinge, eds (Royal Society of Chemistry Publishing, London, UK, 2008).
Cohen et al., "Tunable laboratory extended x-ray absorption fine structure system," Rev. Sci. Instr. vol. 51, No. 3, Mar. 1980, pp. 273-277.
Cong et al., "Fourier transform-based iterative method for differential phase-contrast computed tomography", Opt. Lett. vol. 37 (2012), pp. 1784-1786.
Cornaby et al., "Advances in X-ray Microfocusing with Monocapillary Optics at Chess," Chess News Magazine (2009), pp. 63-66.
Cornaby et al., "Design of Single-Bounce Monocapillary X-ray Optics," Advances in X-ray Analysis: Proceedings of the 55th Annual Conference on Applications of X-ray Analysis, vol. 50, (International Centre for Diffraction Data (ICDD), 2007), pp. 194-200.
Cornaby, "The Handbook of X-ray Single Bounce Monocapillary Optics, Including Optical Design and Synchrotron Applications" (PhD Dissertation, Cornell University, Ithaca, NY, May 2008).
Datta et al., "A new generation of direct X-ray detectors for medical and synchrotron imaging applications," Sci. Reports, vol. 10, p. 20097 (2020).
David et al., "Fabrication of diffraction gratings for hard x-ray phase contrast imaging," Microelectron. Eng. vol. 84, (2007), pp. 1172-1177.
David et al., "Hard X-ray phase imaging and tomography using a grating interferometer," Spectrochimica Acta Part B vol. 62 (2007) pp. 626-630.
Davis et al., "Bridging the Micro-to-Macro Gap: A New Application for Micro X-Ray Fluorescence," Microsc Microanal., vol. 17(3) (Jun. 2011), pp. 410-417.
Diaz et al., "Monte Carlo Simulation of Scatter Field for Calculation of Contrast of Discs in Synthetic CDMAM Images," In: Digital Mammography, Proceedings 10th International Workshop IWDM 2010 (Springer Verlag, Berlin Heidelberg), (2010), pp. 628-635 (9 pages). Jun. 18, 2010.
Ding et al., "Reactive Ion Etching of CVD Diamond Films for MEMS Applications," Micromachining and Microfabrication, Proc. SPIE vol. 4230 (2000), pp. 224-230.
Dittler et al., "A mail-in and user facility for X-ray absorption near-edge structure: the CEI-XANES laboratory X-ray spectrometer at University of Washington," J. Synch. Rad. vol. 26, eight pages, (2019).
Dobrovinskaya et al., "Thermal Properties," Sect. 2.1.5 of "Sapphire: Material, Manufacturing, Applications" (Springer Science + Business Media, New York, 2009).
Dong et al., "Improving Molecular Sensitivity in X-Ray Fluorescence Molecular Imaging (XFMI) of Iodine Distribution in Mouse-Sized Phantoms via Excitation Spectrum Optimization," IEEE Access, vol. 6, pp. 56966-56976 (2018).
Erko et al., "X-ray Optics," Ch. 3 of "Handbook of Practical X-Ray Fluorescence Analysis," B. Beckhoff et al., eds. (Springer, Berlin, Germany, 2006), pp. 85-198.

(56) References Cited

OTHER PUBLICATIONS

Falcone et al., "New directions in X-ray microscopy," Contemporary Physics, vol. 52, No. 4, (Jul.-Aug. 2010), pp. 293-318.
Fernández-Ruiz, "TXRF Spectrometry as a Powerful Tool for the Study of Metallic Traces in Biological Systems," Development in Analytical Chemistry, vol. 1 (2014), pp. 1-14.
Freund, "Mirrors for Synchrotron Beamlines," Ch. 26 of "Handbook of Optics vol. III, 2nd Ed." (McGraw Hill, New York, 2001).
Ge et al., "Investigation of the partially coherent effects in a 2D Talbot interferometer," Anal. Bioanal. Chem. vol. 401. (2011), pp. 865-870. Apr. 29, 2011 pub Jun. 14, 2011.
Gibson et al., "Polycapillary Optics: An Enabling Technology for New Applications," Advances in X-ray Analysis, vol. 45 (2002), pp. 286-297.
Gonzales et al., "Angular distribution of thick-target bremsstrahlung produced by electrons with initial energies ranging from 10 to 20 keV incident on Ag", Phys. Rev. A vol. 84 (2011): 052726.
Gonzales et al., "Angular Distribution of Bremsstrahlung Produced by 10-Kev and 20 Kev Electrons Incident on a Thick Au Target", in Application of Accelerators in Research and Industry, AIP Conf. Proc. 1221 (2013), pp. 114-117.
Graetz et al., "Lenseless C-ray Nano-Tomography down to 150 nm Resolution: On the Quantification of Modulation Transfer and Focal Spot of the Lab-based ntCT System," arXiv:2009.11749v1 [physics. ins-det] Sep. 24, 2020, 10 pages.
Günther et al., "Full-field structured-illumination super-resolution X-ray transmission microscopy," Nature Comm. 10:2494 (2019) and supplementary information.
Guttmann et al., "Ellipsoidal capillary as condenser for the BESSY full-field x-ray microscope," J. Phys. Conf. Ser. vol. 186 (2009): 012064.
Harasse et al., "X-ray Phase Laminography with Talbot Interferometer", in Developments in X-Ray Tomography VII, Proc. SPIE vol. 7804 (2010), 780411.
Harasse et al., "Iterative reconstruction in x-ray computed laminography from differential phase measurements", Opt. Express. vol. 19 (2011), pp. 16560-16573.
Harasse et al., "X-ray Phase Laminography with a Grating Interferometer using Iterative Reconstruction", in International Workshop on X-ray and Neutron Phase Imaging with Gratings, AIP Conf. Proc. vol. 1466, (2012), pp. 163-168.
Hashimoto et al., "Improved reconstruction method for phase stepping data with stepping errors and dose fluctuations," Optics Express, vol. 28, No. 11, pp. 16363-16384 (2020).
Hasse et al., "New developments in laboratory-based x-ray sources and optics," Adv. in Laboratory-based X-Ray Sources, Optics, and Applications VI, ed. A.M. Khounsary, Proc. SPIE vol. 10387, 103870B-1 (2017).
Hemraj-Benny et al., "Near-Edge X-ray Absorption Fine Structure Spectroscopy as a Tool for Investigating Nanomaterials," Small, vol. 2(1), (2006), pp. 26-35.
Henke et al., "X-ray interactions: photoabsorption, scattering, transmission, and reflection at E=50-30000 eV, Z=1-92," Atomic Data and Nuclear Data Tables, vol. 54 (No. 2) (Jul. 1993), pp. 181-342.
Hennekam et al., "Trace metal analysis of sediment cores using a novel X-ray fluorescence core scanning method," Quaternary Int'l, https://doi.org/10.1016/j.quaint.2018.10.018 (2018).
Honma et al., Full-automatic XAFS Measurement System of the Engineering Science Research II beamline BL14B2 at Spring-8, 2011, AIP Conference Proceedings 1234, pp. 13-16.
Howard et al., "High-Definition X-ray Fluorescence Elemental Mapping of Paintings," Anal. Chem., 2012, vol. 84(7), pp. 3278-3286.
Howells, "Mirrors for Synchrotron-Radiation Beamlines," Publication LBL-34750 (Lawrence Berkeley Laboratory, Berkeley, CA, Sep. 1993).
Howells, "Gratings and Monochromators in the VUV and Soft X-Ray Spectral Region," Ch. 21 of "Handbook of Optics," vol. III, 2nd Ed. (McGraw Hill, New York, 2001).
Hrdy et al., "Diffractive-Refractive Optics: X-ray Crystal Monochromators with Profiled Diffracting Surfaces," Ch. 20 of "Modern Developments in X-Ray and Neutron Optics," A. Erko et al., eds. (Springer, Berlin Heidelberg New York, 2008).
Huang et al., "Theoretical analysis and optimization of highly efficient multilayer-coated blazed gratings with high fix-focus constant for the tender X-ray region," Op. Express Vo. 28, No. 2, pp. 821-845 (2020).
Hwang et al, "New etching process for device fabrication using diamond," Diamond & Related Materials, vol. 13 (2004) pp. 2207-2210.
Ide-Ektessabi et al., "The role of trace metallic elements in neurodegenerative disorders: quantitative analysis using XRF and XANES spectroscopy," Anal. Sci., vol. 21(7) (Jul. 2005), pp. 885-892.
Ihsan et al., "A microfocus X-ray tube based on a microstructured X-ray target", Nuclear Instruments and Methods in Physics Research B vol. 267 (2009) pp. 3566-3573.
Ishisaka et al., "A New Method of Analyzing Edge Effect in Phase Contrast Imaging with Incoherent X-rays," Optical Review, vol. 7, No. 6, (2000), pp. 566-572.
Ito et al., "A Stable In-Laboratory EXAFS Measurement System," Jap. J. Appl. Phys., vol. 22, No. 2, Feb. 1, 1983, pp. 357-360.
Itoh et al., "Two-dimensional grating-based X-ray phase-contrast imaging using Fourier transform phase retrieval," Op. Express, vol. 19, No. 4 (2011) pp. 3339-3346.
Janssens et al, "Recent trends in quantitative aspects of microscopic X-ray fluorescence analysis," TrAC Trends in Analytical Chemistry 29.6 (Jun. 2010): 464-478.
Jahrman et al., "Vacuum formed temporary spherically and toroidally bent crystal analyzers for x-ray absorption and x-ray emission spectroscopy," Rev. Sci. Inst. vol. 90, 013106 (2019).
Jiang et al., "X-Ray Phase-Contrast Imaging with Three 2D Gratings," Int. J. Biomed. Imaging, (2008), 827152, 8 pages.
Jin et al., "Development of an X-ray tube with two selective targets modulated by a magnetic field," Rev. Sci. Inst. vol. 90, 083105 (2019).
Joy, "Astronomical X-ray Optics," Ch. 28 of "Handbook of Optics vol. III, 2nd Ed.," (McGraw Hill, New York, 2001).
Kalasová et al., "Characterization of a laboratory-based X-ray computed nanotomography system for propagation-based method of phase contrast imaging," IEEE Trans. on Instr. and Meas., DOI 10.1109/TIM.2019.2910338 (2019).
Keyrilainen et al., "Phase contrast X-ray imaging of breast," Acta Radiologica, vol. 51 (8), (2010), pp. 866-884. Jan. 18, 2010 pub Jun. 15, 2010.
Kidalov et al., "Thermal Conductivity of Diamond Composites," Materials, vol. 2 (2009) pp. 2467-2495.
Kido et al., "Bone Cartilage Imaging with X-ray Interferometry using a Practical X-ray Tube", in Medical Imaging 2010: Physics of Medical Imaging, Proc. SPIE vol. 7622 (2010), 762240.
Kim, "Talbot images of wavelength-scale amplitude gratings," Opt. Express vol. 20(5), (2012), pp. 4904-4920.
Kim et al., "Observation of the Talbot Effect at Beamline 6C Bio Medical Imaging of the Pohang Light Source-II," J. Korean Phys. Soc., vol. 74, No. 10, pp. 935-940 (May 2019).
Kim et al., "A Simulation Study on the Transfer Characteristics of the Talbot Pattern Through Scintillation Screens in the Grating Interferometer," J. Rad. Sci. and Tech. 42(1), pp. 67-75 (2019).
Kirkpatrick et al., "Formation of Optical Images by X-Rays", J. Opt. Soc. Am. vol. 38(9) (1948), pp. 766-774.
Kirz, "Phase zone plates for x-rays and the extreme uv," J. Op. Soc. Am. vol. 64 (Mar. 1974), pp. 301-309.
Kirz et al., "The History and Future of X-ray Microscopy", J. Physics: Conden. Series vol. 186 (2009): 012001.
Kiyohara et al., "Development of the Talbot-Lau Interferometry System Available for Clinical Use", in International Workshop on X-ray and Neutron Phase Imaging with Gratings, AIP Cong. Proc. vol. 1466, (2012), pp. 97-102.
Klockenkämper et al., "7.1 Instrumental Developments" and "7.3 Future Prospects by Combinations," from Chapter 7 of Total Reflection X-ray Fluorescence Analysis and Related Methods 2nd Ed. (J. Wiley and Sons, Hoboken, NJ, 2015).

(56) References Cited

OTHER PUBLICATIONS

Klockenkämper et al., "Chapter 3: Instrumentation for TXRF and GI-XRF," Total Reflection X-ray Fluorescence Analysis and Related Methods 2nd Ed. (J. Wiley and Sons, Hoboken, NJ, 2015).
Kottler et al., "A two-directional approach for grating based differential phase contrast imaging using hard x-rays," Opt. Express vol. 15(3), (2007), pp. 1175-1181.
Kottler et al., "Dual energy phase contrast x-ray imaging with Talbot-Lau interferometer," J. Appl. Phys. vol. 108(11), (2010), 114906. Jul. 7, 2010 pub Dec. 7, 2010.
Kulow et al., "On the Way to Full-Field X-ray Fluorescence Spectroscopy Imaging with Coded Apertures," J. Anal. At. Spectrom. Doi: 10.1039/C9JA00232D (2019).
Kumakhov et al., "Multiple reflection from surface X-ray optics," Physics Reports, vol. 191(5), (1990), pp. 289-350.
Kumakhov, "X-ray Capillary Optics. History of Development and Present Status" in Kumakhov Optics and Application, Proc. SPIE 4155 (2000), pp. 2-12.
Kuwabara et al., "Hard-X-ray Phase-Difference Microscopy with a Low-Brilliance Laboratory X-ray Source", Appl. Phys. Express vol. 4 (2011) 062502.
Kuznetsov, "X-Ray Optics Calculator," Institute of Microelectronics Technology and High Purity Materials, Russian Academy of Sciences (IMT RAS), Chernogolovka, Russia (6 pages submitted); 2016.
Lagomarsino et al., "Reflective Optical Arrays," Ch. 19 of "Modern Developments in X-Ray and Neutron Optics," A. Erko et al. eds. (Springer, Berlin, Germany, 2008), pp. 307-317.
Lai, "X-Ray Microfocusing Optics," Slide Presentation from Argonne National Laboratory, 71 slides, Cheiron Summer School 2007.
Langhoff et al., "X-ray Sources," Ch. 2 of "Handbook of Practical X-Ray Fluorescence Analysis," B. Beckhoff et al., eds. (Springer, Berlin Heidelberg New York, 2006), pp. 33-82.
Lechner et al., "Silicon drift detectors for high count rate X-ray spectroscopy at room temperature," Nuclear Instruments and Methods, vol. 458A (2001), pp. 281-287.
Leenaers et al., "Application of Glancing Incidence X-ray Analysis," 1997, X-ray Spectrometry, vol. 26, pp. 115-121.
Lengeler et al., "Refractive X-ray Optics," Ch. 20 of "Handbook of Optics vol. III, 2nd Ed." (McGraw Hill, New York, 2001).
Li et al., "Source-optic-crystal optimisation for compact monochromatic imaging," Proc. SPIE 5537 (2004), pp. 105-114.
Li et al., "X-ray phase-contrast imaging using cascade Talbot-Lau interferometers," Proc. SPIE 10964 (2018), pp. 1096469-1-1096469-6.
Li et al., "Study on High Thermal Conductivity of X-ray Anode with Composite Diamond Substrate," J. Phys.: Conf. Ser., vol. 1300, 012115 (2019).
Li et al., "Production and Heat Properties of an X-ray Reflective Anode Based on a Diamond Heat Buffer Layer," Materials vol. 13, p. 241 (2020).
Lohmann et al., "An interferometer based on the Talbot effect," Optics Communications vol. 2 (1971), pp. 413-415.
Lübcke et al., "Soft X-ray nanoscale imaging using a sub-pixel resolution charge coupled device (CCD) camera," Rev. Sci. Instrum. vol. 90, 043111 (2019).
Lühl et al., "Scanning transmission X-ray microscopy with efficient X-ray fluorescence detection (STXM-XRF) for biomedical applications in the soft and tender energy range," J. Synch. Rad. vol. 26, https://doi.org/10.1107/S1600577518016879, (2019).
MacDonald et al., "Polycapillary X-ray Optics for Microdiffraction," J. Appl. Cryst., vol. 32 (1999) pp. 160-167.
MacDonald et al., "Polycapillary and Multichannel Plate X-Ray Optics," Ch. 30 of "Handbook of Optics vol. III, 2nd Ed.," (McGraw Hill, New York, 2001).
MacDonald et al., "An Introduction to X-ray and Neutron Optics," Ch. 19 of "Handbook of Optics vol. III, 2nd Ed." (McGraw Hill, New York, 2001).
MacDonald, "Focusing Polycapillary Optics and Their Applications," X-Ray Optics and Instrumentation, vol. 2010, (Oct. 2010): 867049.
Maj et al., "Etching methods for improving surface imperfections of diamonds used for x-ray monochromators," Adv. X-ray Anal., vol. 48 (2005), pp. 176-182.
Malgrange, "X-ray Optics for Synchrotron Radiation," ACTA Physica Polonica A, vol. 82(1) (1992) pp. 13-32.
Malzer et al., "A laboratory spectrometer for high throughput X-ray emission spectroscopy in catalysis research," Rev. Sci. Inst. 89, 113111 (2018).
Masuda et al., "Fabrication of Through-Hole Diamond Membranes by Plasma Etching Using Anodic Porous Alumina Mask," Electrochemical and Solid-State Letters, vol. 4(11) (2001) pp. G101-G103.
Matsushita, "Mirrors and Multilayers," Slide Presentation from Photon Factor, Tsukuba, Japan, 65 slides, (Cheiron School 2009, Sprint-8, Japan, Nov. 2009).
Matsushita, "X-ray monochromators," Slide Presentation from Photon Factory, Tsukuba, Japan, 70 slides, (Cheiron School 2009, Spring-8, Japan, Nov. 2009).
Matsuyama et al., "Wavefront measurement for a hard-X-ray nanobeam using single-grating interferometry", Opt Express vol. 20 (2012), pp. 24977-24986.
Miao et al., "Motionless phase stepping in X-ray phase contrast imaging with a compact source," Proceedings of the National Academy of Sciences, vol. 110(48), (2013), pp. 19268-19272.
Michette, "Zone and Phase Plates, Bragg-Fresnel Optics," Ch. 23 of "Handbook of Optics vol. III, 2nd Ed.," (McGraw Hill, New York, 2001).
Mijovilovich et al., "Analysis of trace metal distribution in plants with lab-based microscopic X-ray fluorescence imaging," Plant Methods, vol. 16, No. 82, 21 pages (2020).
Mizutani et al., X-ray microscopy for neural circuit reconstruction in 9th International Conference on X-Ray Microscopy, J. Phys: Conf. Ser. 186 (2009) 012092.
Modregger et al., "Grating-Based X-ray Phase Contrast Imaging," Ch. 3 of Emerging Imaging Technologies in Medicine, M. Anastasio & P. La Riviere, ed., Crc Press, Boca Raton, FL, (2012), pp. 43-56.
Momose et al., "Phase-Contrast X-Ray Imaging Using an X-Ray Interferometer for Biological Imaging", Analytical Sciences vol. 17 Supplement (2001), pp. i527-i530.
Momose et al.,"Demonstration of X-Ray Talbot Interferometry", Jpn. J. Appl. Phys. vol. 42 (2003), pp. L866-L868.
Momose et al.,"Phase Tomography Using an X-ray Talbot Interferometer", in Developments in X-Ray Tomography IV, Proc. SPIE vol. 5535 (2004), pp. 352-360.
Momose, "Recent Advances in X-ray Phase Imaging", Jpn. J. Appl. Phys. vol. 44 (2005), pp. 6355-6367.
Momose et al., "Biomedical Imaging by Talbot-Type X-Ray Phase Tomography" in Developments in X-Ray Tomography V, Proc. SPIE vol. 6318 (2006) 63180T.
Momose et al., "Phase Tomography by X-ray Talbot Interferometry for Biological Imaging" Jpn. J. Appl. Phys. vol. 45 2006 pp. 5254-5262.
Momose et al., "X-ray Talbot Interferometry with Capillary Plates", Jpn. J. Appl. Phys. vol. 45 (2006), pp. 314-316.
Momose et al., "Phase Imaging with an X-ray Talbot Interferometer", Advances in X-ray Analysis vol. 49(3) (2006), pp. 21-30.
Momose et al., "Phase Tomography Using X-ray Talbot Interferometer", in Synchrotron Radiation Instrumentation: Ninth International Conference, AIP Conf. Proc. vol. 879 (2007), pp. 1365-1368.
Momose et al., "Sensitivity of X-ray Phase Imaging Based on Talbot Interferometry", Jpn. J. Appl. Phys. vol. 47 (2008), pp. 8077-8080.
Momose et al., "Grating-Based X-ray Phase Imaging Using Multiline X-ray Source", Jpn. J. Appl. Phys. vol. 48 (2009), 076512.
Momose et al., "X-ray phase tomography with a Talbot interferometer in combination with an X-ray imaging microscope", in 9th International Conference on X-Ray Microscopy, J. Phys: Conf. Ser. 186 (2009) 012044.
Momose et al., "High-speed X-ray phase imaging and X-ray phase tomography with Talbot interferometer and white synchrotron radiation", Opt. Express vol. 17 (2009), pp. 12540-12545.

(56) References Cited

OTHER PUBLICATIONS

Momose et al., "X-Ray Phase Imaging with Talbot Interferometry", in "Biomedical Mathematics: Promising Directions in Imaging, Therapy Planning, and Inverse Problems", Y. Censor, M. Jiang & G.Wang, eds. (Medical Physics Publishing, Madison, WI, USA, 2010), pp. 281-320.
Momose et al., "X-ray Phase Measurements with Talbot Interferometry and Its Applications", in International Conference on Advanced Phase Measurement Methods in Optics and Imaging, AIP Conf. Proc. vol. 1236 (2010), pp. 195-199.
Momose et al., "X-ray Phase Imaging Using Lau Effect", Appl. Phys. Express vol. 4 (2011) 066603.
Momose et al., "Four-dimensional X-ray phase tomography with Talbot interferometry and white synchrotron radiation: dynamic observation of a living worm", Opt. Express vol. 19 (2011), pp. 8423-8432.
Momose et al., "X-ray Phase Imaging—From Static Observation to Dynamic Observation—", in International Workshop on X-ray and Neutron Phase Imaging with Gratings AIP Conf. Proc. vol. 1466, (2012), pp. 67-77.
Momose et al., "Recent Progress in X-ray and Neutron Phase Imaging with Gratings," Quantum Beam Science, vol. 4, No. 9; doi:10.3390/qubs4010009 (2020).
Montgomery, "Self Imaging Objects of Infinite Aperture," J. Opt. Soc. Am. vol. 57(6), (1967), pp. 772-778.
Morimoto et al., "Development of multiline embedded X-ray targets for X-ray phase contrast imaging," XTOP 2012 Book of Abstracts, (Ioffe Physical-Technical Institute of the Russian Academy of Sciences, St. Petersburg, Russia, 2012), pp. 74-75.
Morimoto et al., "X-ray phase contrast imaging by compact Talbot-Lau interferometer with a signal transmission grating," 2014, Optics Letters, vol. 39, No. 15, pp. 4297-4300.
Morimoto et al., "Design and demonstration of phase gratings for 2D single grating interferometer," Optics Express vol. 23, No. 23, 29399 (2015).
Munro et al., Design of a novel phase contrast imaging system for mammography, 2010, Physics in Medicine and Biology, vol. 55, No. 14, pp. 4169-4185.
Nango et al., "Talbot-defocus multiscan tomography using the synchrotron X-ray microscope to study the lacuno-canalicular network in mouse bone", Biomed. Opt. Express vol. 4 (2013), pp. 917-923.
Neuhausler et al., "Non-destructive high-resolution X-ray imaging of ULSI micro-electronics using keV X-ray microscopy in Zernike phase contrast," Microelectronic Engineering, Elsevier Publishers BV., Amsterdam, NO, vol. 83, No. 4-9 (Apr. 1, 2006) pp. 1043-1046.
Newville, "Fundamentals of XAFS," (Univ. Of Chicago, Chicago, IL, Jul. 23, 2004).
Noda et al., "Fabrication of Diffraction Grating with High Aspect Ratio Using X-ray Lithography Technique for X-ray Phase Imaging," Jpn. J. Appl. Phys. vol. 46, (2007), pp. 849-851.
Noda et al., "Fabrication of High Aspect Ratio X-ray Grating Using X-ray Lithography" J. Solid Mech_ Mater. Eng. vol. 3 (2009), pp. 416-423.
Nojeh, "Carbon Nanotube Electron Sources: From Electron Beams to Energy Conversion and Optophononics", ISRN Nanomaterials vol. 2014 (2014): 879827.
Nuhn, "From storage rings to free electron lasers for hard x-rays", J.A37 Phys.: Condens. Matter vol. 16 (2004), pp. S3413-S34121.
Nykanen et al., "X-ray scattering in full-field digital mammography," Med. Phys. vol. 30(7), (2003), pp. 1864-1873.
Oji et al., Automatic XAFS measurement system developed at BL14B2 in SPring-8, Available online Nov. 15, 2011, Journal of Synchrotron Radiation, vol. 19, pp. 54-59.
Olbinado et al., "Demonstration of Stroboscopic X-ray Talbot Interferometry Using Polychromatic Synchrotron and Laboratory X-ray Sources", Appl. Phys. Express vol. 6 (2013), 096601.
Ortega et al., "Bio-metals imaging and speciation in cells using proton and synchrotron radiation X-ray microspectroscopy," J. Royal Society Interface vol. 6 suppl. 5 (Oct. 6, 2009), pp. 6S649-6S658.
Otendal et al., A 9 keV electron-impact liquid-gallium-jet x-ray source, Rev. Sci. Instrum. vol. 79 (2008): 016102.
Oxford Instruments Inc., Series 5000 Model XTF5011 X-ray Tube information, Jun. 1998, 3 pages.
Pandeshwar et al., "Modeling of beam hardening effects in a dual-phase X-ray grading interferometer for quantitative dark-field imaging," Optics Express, vol. 28, No. 13, Jun. 22, 2020, pp. 19187-19204 (2020).
Parrill et al., "GISAXS—Glancing Incidence Small Angle X-ray Scattering," Journal de Physique IV, vol. 3 (Dec. 1993), pp. 411-417.
Paunesku et al., "X-Ray Fluorescence Microprobe Imaging in Biology and Medicine," J. Cell. Biochem. vol. 99, pp. 1489-1502 (2006).
Paxscan Flat Panel X-ray Imaging, Varian Sales Brochure, (Varian Medical Systems, Palo Alto, CA, Nov. 11, 2004).
Penkov et al., "X-Ray Calc: A software for the simulation of X-ray reflectivity," SoftwareX, vol. 12, p. 100528 (2020).
Pfeiffer et al., "Phase retrieval and differential phase-contrast imaging with low-brilliance X-ray sources," Nature Physics vol. 2, (2006), pp. 258-261.
Pfeiffer et al., "Hard x-ray phase tomography with low brilliance x-ray sources," Phys. Rev. Lett. vol. 98, (2007), 108105.
Pfeiffer et al., "Hard-X-ray dark-field imaging using a grating interferometer," Nature Materials vol. 7, (2008), pp. 134-137.
Pfeiffer, "Milestones and basic principles of grating-based x-ray and neutron phase-contrast imaging," in International Workshop on X-ray and Neutron Phase Imaging with Gratings AIP Conf. Proc. vol. 1466, (2012), pp. 2-11.
Pianetta et al., "Application of synchrotron radiation to TXRF analysis of metal contamination on silicon wafer surfaces," Thin Solid Films, vol. 373(1-2), 2000, pp. 222-226.
Potts, "Electron Probe Microanalysis", Ch. 10 of "A Handbook of Silicate Rock Analysis" (Springer Science+ Business Media, New York, 1987), pp. 326-382 (equation quoted from p. 336).
Prewitt et al., "Focused ion beam repair: staining of photomasks and reticles," J. Phys. D Appl. Phys. vol. 26 (1993), pp. 1135-1137.
Prewitt et al., "Gallium Staining in FIB Repair of Photomasks," Microelectronic Engineering, vol. 21 (1993), pp. 191-196.
Prewitt et al., "FIB Repair of 5X Reticles and Effects on IC Quality," Integrated Circuit Metrology, Inspection, and Process Control VII, Proc. SPIE vol. 1926 (1993), pp. 517-526.
Pushie et al., "Prion protein expression level alters regional copper, iron and zinc content in the mouse brain," Metallomics vol. 3, 206-214 (2011).
Pushie et al., "Elemental and Chemically Specific X-ray Fluorescence Imaging of Biological Systems," Chem. Rev. 114:17, 8499-8541 (2014).
Qin et al., "Trace metal imaging with high spatial resolution: Applications in biomedicine," Metallomics, vol. 3 (Jan. 2011), pp. 28-37.
Rayleigh, "On copying diffraction gratings and some phenomena connected therewith," Philos. Mag. vol. 11 (1881), pp. 196-205.
Redus et al., "Spectrometer configuration and measurement uncertainty in X-ray spectroscopy," X-Ray Spectrom., pp. 1-14 (2020).
Renaud et al., "Probing surface and interface morphology with Grazing Incidence Small Angle X-ray Scattering," Surface Science Reports, vol. 64:8 (2009), pp. 255-380.
Riege, "Electron Emission from Ferroelectrics—A Review", CERN Report CERN AT/93-18 (CERN, Geneva, Switzerland, Jul. 1993).
Rix et al., "Super-Resolution X-ray phase-contrast and dark-field imaging with a single 2D grating and electromagnetic source stepping," Phys. Med. Biol. In press https://doi.org/10.1088/1361-6560/ab2ff5 (2019).
Romano et al., "Microfabrication of X-ray Optics by Metal Assisted Chemical Etching: Aa Review," Micromachines, vol. 11, No. 589, 23 pages (2020).

(56) References Cited

OTHER PUBLICATIONS

Röntgen, "Ueber eine neue Art von Strahlen (Wurzburg Verlag, Wurzburg, Germany, 1896) also, in English, On a New Kind of Rays," Nature vol. 53 (Jan. 23 1896). pp. 274-276.
Rovezzi, "Study of the local order around magnetic impurities in semiconductors for spintronics." PhD Dissertation, Condensed Matter, Université Joseph-Fourier—Grenoble I, 2009, English <tel-00442852>.
Rutishauser, "X-ray grating interferometry for imaging and metrology," 2003, ETH Zurich, Diss. ETH No. 20939.
Salditt, "Nanoscale Photonic Imaging," Topics in Applied Physics, vol. 134, T. Salditt et al., eds., Springer Open, 2020.
Sato et al., Two-dimensional gratings-based phase-contrast imaging using a conventional x-ray tube, 2011, Optics Letters, vol. 36, No. 18, pp. 3551-3553.
Scherer et al., "Bi-Directional X-Ray Phase-Contrast Mammography," PLoS ONE, vol. 9, Issue 5 (May 2014) e93502.
Scholz, "X-ray Tubes and Monochromators," Technical Workshop EPIC, Universität Würzburg (2007); 41 slides, 2007.
Scholze et al., "X-ray Detectors and XRF Detection Channels," Ch. 4 of "Handbook of Practical X-Ray Fluorescence Analysis," B. Beckhoff et al., eds. (Springer, Berlin Heidelberg, Germany, 2006), pp. 85-198.
Scordo et al., "Pyrolytic Graphite Mosaic Crystal Thickness and Mosaicity Optimization for an Extended Source Von Hamos X-ray Spectrometer," Condens. Matter Vo. 4, pp. 38-52 (2019).
Scott, "Hybrid Semiconductor Detectors for High Spatial Resolution Phase-contrast X-ray Imaging," Thesis, University of Waterloo, Department of Electrical and Computer Engineering, 2019.
Sebert, "Flat-panel detectors:how much better are they?" Pediatr. Radiol. vol. 36 (Suppl 2), (2006), pp. 173-181.
Seifert et al., "Talbot-Lau x-ray phase-contrast setup for fast scanning of large samples," Sci. Rep. 9:4199, pp. 1-11 (2019).
Senba et al., "Stable sub-micrometre high-flux probe for soft X-ray ARPES using a monolithic Wolter mirror," J. Synch. Rad., vol. 27, 5 pages, (2020).
Shen, "Polarizing Crystal Optics," Ch. 25 of "Handbook of Optics vol. III, 2nd Ed.," (McGraw Hill, New York, 2001).
Shi et al., "Towards the Fabrication of High-Aspect-Ratio Silicon Gratings by Deep Reactive Ion Etching," Micromachines, vol. 11, p. 864, 13 pages (2020).
Shields et al., "Overview of Polycapillary X-ray Optics," Powder Diffraction, vol. 17(2) (Jun. 2002), pp. 70-80.
Shimura et al., "Hard x-ray phase contrast imaging using a tabletop Talbot-Lau interferometer with multiline embedded x-ray targets", Opt. Lett. vol. 38(2) (2013), pp. 157-159.
Siddons, "Crystal Monochromators and Bent Crystals," Ch. 22 of "Handbook of Optics vol. III, 2nd Ed.," (McGraw Hill, New York, 2001).
Smith, "Fundamentals of Digital Mammography:Physics, Technology and Practical Considerations," Publication R-BI-016 (Hologic, Inc., Bedford, MA, Mar. 2005).
Snigirev et al., "Hard X-Ray Microoptics," Ch. 17 of "Modern Developments in X-Ray and Neutron Optics," A. Erko et al., eds (Springer, Berlin, Germany, 2008), pp. 255-285.
Sparks Jr., "X-ray Fluorescence Microprobe for Chemical Analysis," in Synchrotron Radiation Research, H. Winick & S. Doniach, eds. (Plenum Press, New York, NY 1980), pp. 459-512.
Spiller, "Multilayers," Ch. 24 of "Handbook of Optics vol. III, 2nd Ed.," (McGraw Hill, New York, 2001).
Stampanoni et al., "The First Analysis and Clinical Evaluation of Native Breast Tissue Using Differential Phase-Contrast Mammography," Investigative Radiology, vol. 46, pp. 801-806. pub 2011-12-xx.
Strüder et al., "X-Ray Detectors," Ch. 4 of "X-ray Spectrometry: Recent Technological Advances," K. Tsuji et al. eds. (John Wiley & Sons, Ltd. Chichester, West Sussex, UK, 2004), pp. 63-131.
Strüder et al., "Silicon Drift Detectors for X-ray Imaging," Presentation at Detector Workshop on Synchrotron Radiation Instrumentation, 54 slides, (Argonne Nat'l Lab, Argonne, IL Dec. 8, 2005), available at: http://www.aps.anl.gov/News/Conferences/2005/Synchrotron_Radiation_Instrumentation/Presentations/Strueder.pdf.
Stupple et al., "Modeling of Heat Transfer in an Aluminum X-Ray Anode Employing a Chemical Vapor Deposited Diamond Heat Spreader," J. Heat Transfer, Vo. 140, 124501-1-5 (Dec. 2018).
Sun et al., "Numerical design of in-line X-ray phase-contrast imaging based on ellipsoidal single-bounce monocapillary," Nucl. Inst. and Methods in Phys. Res. A746 (2014) pp. 33-38.
Sun et al., "Combined optic system based on polycapillary X-ray optics and single-bounce monocapillary optics for focusing X-rays from a conventional laboratory X-ray source," Nucl. Inst. and Methods in Phys. Res. A 802 (2015) pp. 5-9.
Sunday et al., "X-ray Metrology for the Semiconductor Industry Tutorial," J. Res. Nat'l Inst. Stan. vol. 124: 124003 (2019); https://doi.org/10.6028/jres.124.003.
Suzuki, "Development of the DIGITEX Satire Cardiac System Equipped with Direct conversion Flat Panel Detector," Digital Angio Technical Report (Shimadzu Corp., Kyoto, Japan, no date, published—2004 with product release).
Suzuki et al., "Hard X-ray Imaging Microscopy using X-ray Guide Tube as Beam Condenser for Field Illumination," J. Phys.: Conf. Ser. vol. 463 (2013): 012028.
Takahama, "RADspeed safire Digital General Radiography System Equipped with New Direct—Conversion FPD," Medical Now, No. 62 (2007).
Takeda et al., "X-Ray Phase Imaging with Single Phase Grating", Jpn. J. Appl. Phys. vol. 46 (2007), pp. L89-L91.
Takeda et al., "Differential Phase X-ray Imaging Microscopy with X-ray Talbot Interferometer" Appl. Phys. Express vol. 1 (2008) 117002.
Takeda et al., "In vivo physiological saline-infused hepatic vessel imaging using a two-crystal-interferometer-based phase-contrast X-ray technique", J. Synchrotron Radiation vol. 19 (2012), pp. 252-256.
Takeo et al., "Soft x-ray nanobeam formed by an ellipsoidal mirror," Appl. Phys. Lett., vol. 116, 121102 (2020).
Takeo et al., "A highly efficient nanofocusing system for soft x rays," Appl. Phys. Lett., vol. 117, 151104 (2020).
Talbot, "Facts relating to optical science No. IV," Philos. Mag. vol. 9 (1836), pp. 401-407.
Tanaka et al., "Cadaveric and in vivo human joint imaging based on differential phase contrast by X-ray Talbot-Lau interferometry", Z. Med. Phys. vol. 23 (2013), pp. 222-227.
Tang et al., "Micro-computed tomography (Micro-CT): a novel approach for intraoperative breast cancer specimen imaging," Breast Cancer Res. Treat. vol. 139, pp. 311-316 (2013).
Taniguchi et al., "Diamond nanoimprint lithography," Nanotechnology, vol. 13 (2002) pp. 592-596.
Taphorn et al., "Grating-based spectral X-ray dark-field imaging for correlation with structural size measures," Sci. Reports, vol. 10, 13195 (2020).
Terzano et al., Recent advances in analysis of trace elements in environmental samples by X-ray based techniques (IUPAC Technical Report), Pure Appl. Chem. 2019.
Tkachuk et al., "High-resolution x-ray tomography using laboratory sources", in Developments in X-Ray Tomography V, Proc. SPIE 6318 (2006): 631810.
Tkachuk et al., "Multi-length scale x-ray tomography using laboratory and synchrotron sources", Microsc. Microanal. vol. 13 (Suppl. 2) (2007), pp. 1570-1571.
Töpperwien et al., "Multiscale x-ray phase-contrast tomography in a mouse model of transient focal cerebral ischemia," Biomed. Op. Express, vol. 10, No. 1, Jan. 2019, pp. 92-103.
Touzelbaev et al., "Applications of micron-scale passive diamond layers for the integrated circuits and microelectromechanical systems industries," Diamond and Rel. Mat'ls, vol. 7 (1998) pp. 1-14.
Tsuji et al., "X-Ray Spectrometry: Recent Technological Advances," John Wiley & Sons Ltd. Chichester, West Susses, Uk 2004), Chapters 1-7.
Tucker, "Design of X-Ray Source for Real-Time Computed Tomography," Dissertation, Missouri Univ. of Sci. And Tech., Scholars' Mine, 104 pages (2020).

(56) References Cited

OTHER PUBLICATIONS

Udagawa, "An Introduction to In-House EXAFS Facilities," The Rigaku Journal, vol. 6, (1) (1989), pp. 20-27.
Udagawa, "An Introduction to X-ray Absorption Fine Structure," The Rigaku Journal, vol. 11(2)(1994), pp. 30-39.
Uehara et al., "Effectiveness of X-ray grating interferometry for non-destructive inspection of packaged devices", J. Appl. Phys. vol. 114 (2013), 134901.
Viermetz et al., "High resolution laboratory grating-based X-ray phase-contrast CT," Scientific Reports 8:15884 (2018).
Vogt, "X-ray Fluorescence Microscopy: A Tool for Biology, Life Science and Nanomedicine," Presentation on May 16, 2012 at James Madison Univ., Harrisonburg, VA (31 slides), 2012.
Wan et al.,"Fabrication of Multiple Slit Using Stacked-Sliced Method for Hard X-ray Talbot—Lau Interferometer", Jpn. J. Appl. Phys. vol. 47 (2008), pp. 7412-7414.
Wang et al., "Precise patterning of diamond films for MEMS application" Journal of Materials Processing Technology vol. 127 (2002), pp. 230-233.
Wang et al., "Advantages of intermediate X-ray energies in Zernike phase contrast X-ray microscopy," Biotech. Adv., vol. 31 (2013) pp. 387-392.
Wang et al., "Non-invasive classification of microcalcifications with phase-contrast X-ray mammography," Nature Comm. vol. 5:3797, pp. 1-9 (2014).
Wang, On the single-photon-counting (SPC) modes of imaging using an XFEL source, presented at IWORLD 2015.
Wang et al., "Measuring the average slope error of a single-bounce ellipsoidal glass monocapillary X-ray condenser based on an X-ray source with an adjustable source size," Nucl. Inst. And Meth. A934, 36-40 (2019).
Wang et al., "High beam-current density of a 10-keV nano-focus X-ray source," Nucl. Inst. and Meth. A940, 475-478 (2019).
Wang et al., "Double-spherically bent crystal high-resolution X-ray spectroscopy of spatially extended sources," Chinese Optics Lett., vol. 18(6), 061101 (2020).
Wansleben et al., "Photon flux determination of a liquid-metal jet x-ray source by means of photon scattering," arXiv:1903.06024v1, Mar. 14, 2019.
Weitkamp et al., "Hard X-ray phase imaging and tomography with a grating interferometer," Proc. SPIE vol. 5535, (2004), pp. 137-142.
Weitkamp et al., "X-ray phase imaging with a grating interferometer," Opt. Express vol. 13(16), (2005), pp. 6296-6304.
Weitkamp et al., "X-ray wavefront analysis and optics characterization with a grating interferometer," Appl. Phys. Lett. vol. 86, (2005), 054101.
Weitkamp et al., Tomography with grating interferometers at low-brilliance sources, 2006, SPIE, vol. 6318, pp. 0S-1 to 0S-10.
Weitkamp et al., "X-ray wavefront diagnostics with Talbot interferometers," International Workshop on X-Ray Diagnostics and Scientific Application of the European XFEL, Ryn, Poland, (2010), 36 slides.
Weitkamp et al., "Design aspects of X-ray grating interferometry," in International Workshop on X-ray and Neutron Phase Imaging with Gratings AIP Conf. Proc. vol. 1466, (2012), pp. 84-89.
Wen et al., "Fourier X-ray Scattering Radiography Yields Bone Structural Information," Radiology, vol. 251 (2009) pp. 910-918.
Wen et al., "Single-shot x-ray differential phase-contrast and diffraction imaging using two-dimensional transmission gratings," Op. Lett. vol. 35, No. 12, (2010) pp. 1932-1934.
Wilde et al., "Modeling of an X-ray grating-based imaging interferometer using ray tracing," Op. Express vol. 28, No. 17, p. 24657 (2020).
Wittry et al., "Properties of fixed-position Bragg diffractors for parallel detection of x-ray spectra," Rev. Sci. Instr. vol. 64, pp. 2195-2200 (1993).
Wobrauschek et al., "Micro XRF of light elements using a polycapillary lens and an ultra-thin window Silicon Drift Detector inside a vacuum chamber," 2005, International Centre for Diffraction Data 2005, Advances in X-ray Analysis, vol. 48, pp. 229-235.
Wobrauschek et al., "Energy Dispersive, X-Ray Fluorescence Analysis," Encyclopedia of Analytical Chemistry, R.A. Meyers, Ed. (Wiley 2010).
Wolter, "Spiegelsysteme streifenden Einfalls als abbildende Optiken fur Rontgenstrahlen" [Grazing Incidence Reflector Systems as Imaging Optics for X-rays] Annalen der Physik vol. 445, Issue 1-2 (1952), pp. 94-114.
X-ray-Optics.de Website, http://www.x-ray-optics.de/, accessed Feb. 13, 2016.
Yakimchuk et al., "Ellipsoidal Concentrators for Laboratory X-ray Sources: Analytical approaches for optimization," Mar. 22, 2013, Crystallography Reports, vol. 58, No. 2, pp. 355-364.
Yamada et al., "Compact full-field hard x-ray microscope based on advanced Kirkpatrick-Baez mirrors," Optica, vol. 7, No. 4 pp. 367-370 (2020).
Yamamoto, "Fundamental physics of vacuum electron sources", Reports on Progress in Physics vol. 69, (2006), pp. 181-232.
Yanagihara et al., "X-Ray Optics," Ch. 3 of "X-ray Spectrometry: Recent Technological Advances," K. Tsuji et al. eds. (John Wiley & Sons, Ltd. Chichester, West Sussex, UK, 2004), pp. 63-131.
Yang et al., "Analysis of Intrinsic Stress in Diamond Films by X-ray Diffraction," Advances in X-ray Analysis, vol. 43 (2000), pp. 151-156.
Yang et al., "Comperative stucy of single-layer, bilayer, and trilayer mirrors with enhanced x-ray reflectance in 0.5- to 80keV energy region," J. Astron. Telesc. Instrum. Syst., vol. 6(4) 044001, 12 pages (2020).
Yashiro et al., "Optimal Design of Transmission Grating for X-ray Talbot Interferometer", Advances in X-ray Analysis vol. 49(3) (2006), pp. 375-379.
Yashiro et al., "Efficiency of capturing a phase image using cone-beam x-ray Talbot interferometry", J. Opt. Soc. Am. A vol. 25 (2008), pp. 2025-2039.
Yashiro et. al., "Hard-X-Ray Phase-Difference Microscopy Using a Fresnel Zone Plate and a Transmission Grating", Phys. Rev. Lett. vol. 103 (2009), 180801.
Yashiro et al., "Hard x-ray phase-imaging microscopy using the self-imaging phenomenon of a transmission grating", Phys. Rev. A vol. 82 (2010), 043822.
Yashiro et al., "On the origin of visibility contrast in x-ray Talbot interferometry", Opt. Express (2010), pp. 16890-16901.
Yashiro et al., "X-ray Phase Imaging Microscopy using a Fresnel Zone Plate and a Transmission Grating", in The 10th International Conference on Synchrotron Radiation Instrumentation, AIP Conf. Proc. vol. 1234 (2010), pp. 473-476.
Yashiro et al., "Distribution of unresolvable anisotropic microstructures revealed in visibility-contrast images using x-ray Talbot interferometry", Phys. Rev. B vol. 84 (2011), 094106.
Yashiro et al., "X-ray Phase Imaging and Tomography Using a Fresnel Zone Plate and a Transmission Grating", in "The 10th International Conference on X-ray Microscopy Radiation Instrumentation", AIP Conf. Proc. vol. 1365 (2011) pp. 317-320.
Yashiro et al., "Theoretical Aspect of X-ray Phase Microscopy with Transmission Gratings" in International Workshop on X-ray and Neutron Phase Imaging with Gratings, AIP Conf. Proc. vol. 1466, (2012), pp. 144-149.
Yoshioka et al., "Imaging evaluation of the cartilage in rheumatoid arthritis patients with an x-ray phase imaging apparatus based on Talbot-Lau interferometry," Scientific Reports, 10:6561, https://doi.org/10.1038/s41598-020-63155-9 (2020).
Yu et al., "Morphology and Microstructure of Tungsten Films by Magnetron Sputtering," Mat. Sci. Forum, vol. 913, pp. 416-423 (2018).
Zanette et al., "Two-Dimensional X-Ray Grating interferometer," Phys. Rev. Lett. vol. 105 (2010) pp. 248102-1 248102-4.
Zeeshan et al., "In-house setup for laboratory-based x-ray absorption fine structure spectroscopy measurements," Rev. Sci. Inst. 90, 073105 (2019).
Zeng et al., "Ellipsoidal and parabolic glass capillaries as condensers for x-ray microscopes," Appl. Opt. vol. 47 (May 2008), pp. 2376-2381.

(56) References Cited

OTHER PUBLICATIONS

Zeng et al., "Glass Monocapillary X-ray Optics and Their Applications in X-Ray Microscopy," X-ray Optics and Microanalysis: Proceedings of the 20th International Congress, AIP Conf. Proc. vol. 1221, (2010), pp. 41-47.
Zhang et al., "Fabrication of Diamond Microstructures by Using Dry and Wet Etching Methods", Plasma Science and Technology vol. 15(6) (Jun. 2013), pp. 552-554.
Zhang et al., "Application of confocal X-ray fluorescence based on capillary X-ray optics in nondestructively measuring the inner diameter of monocapillary optics," Optics Comm. (2018) https://doi.org/10.1016/j.optcom.2018.11.064.
Zhang et al., "Measurement of the inner diameter of monocapillary with confocal X-ray scattering technology based on capillary X-ray optics," Appl. Opt. (Jan. 8, 2019), doc ID 351489, pp. 1-10.
Zhou et al., "Quasi-parallel X-ray microbeam obtained using a parabolic monocapillary X-ray lens with an embedded square-shaped lead occluder," arXiv:2001.04667 (2020).
Zhou et al., "A study of new type electric field modulation multi-target X-ray source," Nucl. Inst. and Methods in Physics Research A, https://doi.org/10.1016/j.nima2020.164342 (2020).
Zhou et al., "X-ray wavefront characterization with grating interferometry using an x-ray microfocus laboratory source," Proceedings, vol. 11492, Advances in Metrology for X-Ray and EUV Optics IX; 114920Q, https://doi.org/10.1117/12.2576152 (2020).

* cited by examiner

HIGH BRIGHTNESS X-RAY REFLECTION SOURCE

CLAIM OF PRIORITY

The present application is a continuation from U.S. patent application Ser. No. 16/518,713 filed Jul. 22, 2019 which claims the benefit of priority to U.S. Provisional Appl. No. 62/703,836, filed Jul. 26, 2018 which is incorporated in its entirety by reference herein.

BACKGROUND

Field

This application relates generally to x-ray sources.

Description of the Related Art

Laboratory x-ray sources generally bombard a metal target with electrons, with the deceleration of these electrons producing Bremsstrahlung x-rays of all energies from zero to the kinetic energy of the electrons. In addition, the metal target produces x-rays by creating holes in the inner core electron orbitals of the target atoms, which are then filled by electrons of the target with binding energies that are lower than the inner core electron orbitals, with concomitant generation of x-rays with energies that are characteristic of the target atoms. Most of the power of the electrons irradiating the target is converted into heat (e.g., about 60%) and backscattered electrons (e.g., about 39%), with only about 1% of the incident power converted into x-rays. Melting of the x-ray target due to this heat can be a limiting factor for the ultimate brightness (e.g., photons per second per area per steradian) achievable by the x-ray source.

Transmission-type x-ray sources configured to generate microfocus or nanofocus x-ray beams generally utilize targets comprising a thin sputtered metal layer (e.g., tungsten) over a thermally conductive, low density substrate material (e.g., diamond). The metal layer on one side of the target is irradiated by electrons, and the x-ray beam comprises x-rays emitted from the opposite side of the target. The x-ray spot size is dependent on the electron beam spot size, and in addition, due to electron bloom within the target, the x-rays generated and emitted from the target have an effective focal spot size that is larger than the focal spot size of the incident electron beam. As a result, transmission-type x-ray sources generating microfocus or nanofocus x-ray beams generally require very thin targets and very good electron beam focusing.

Conventional reflection-type x-ray sources irradiate a surface of a bulk target metal (e.g., tungsten) and collect the x-rays transmitted from the irradiated target surface at a take-off angle (e.g., 6-30 degrees) relative to the irradiated target surface, with the take-off angle selected to optimize the accumulation of x-rays while balancing with self-absorption of x-rays produced in the target. Because the electron beam spot at the target is effectively seen at an angle in reflection-type x-ray sources, the x-ray source spot size can be smaller than the electron beam spot size in transmission-type x-ray sources.

SUMMARY

Certain embodiments described herein provide an x-ray target. The x-ray target comprises a thermally conductive substrate comprising a surface and at least one structure on or embedded in at least a portion of the surface. The at least one structure comprises a thermally conductive first material in thermal communication with the substrate. The first material has a length along a first direction parallel to the portion of the surface in a range greater than 1 millimeter and a width along a second direction parallel to the portion of the surface and perpendicular to the first direction. The width is in a range of 0.2 millimeter to 3 millimeters. The at least one structure further comprises at least one layer over the first material. The at least one layer comprises at least one second material different from the first material. The at least one layer has a thickness in a range of 2 microns to 50 microns. The at least one second material is configured to generate x-rays upon irradiation by electrons having energies in an energy range of 0.5 keV to 160 keV.

Certain embodiments described herein provide an x-ray source. The x-ray source comprises an x-ray target comprising a thermally conductive substrate comprising a surface and at least one structure on or embedded in at least a portion of the surface. The at least one structure comprises a thermally conductive first material in thermal communication with the substrate. The first material has a length along a first direction parallel to the portion of the surface in a range greater than 1 millimeter and a width along a second direction parallel to the portion of the surface and perpendicular to the first direction. The width is in a range of 0.2 millimeter to 3 millimeters. The at least one structure further comprises at least one layer over the first material. The at least one layer comprises at least one second material different from the first material. The at least one layer has a thickness in a range of 2 microns to 50 microns. The at least one second material is configured to generate x-rays upon irradiation by electrons having energies in an energy range of 0.5 keV to 160 keV. The x-ray source further comprises an electron source configured to generate electrons in at least one electron beam and to direct the at least one electron beam to impinge the at least one structure.

DETAILED DESCRIPTION

Certain embodiments described herein provide a reflection-type x-ray source which advantageously achieves small x-ray spot sizes while using electron beam spot sizes larger than those used in transmission-type x-ray sources (e.g., utilizing less rigorous electron beam focusing as compared to that used in transmission-type x-ray sources).

Certain embodiments described herein advantageously provide a reflection-type x-ray source with a high brightness of x-rays while avoiding the deleterious effects of excessive heating of the target. By using a cooled substrate and a high thermal conductivity first material (e.g., diamond) in thermal communication with the substrate and having a target layer of a second material deposited on the first material, heat can advantageously be removed from the target layer at a rate faster than would be achieved by removing the heat through bulk target material.

Certain embodiments described herein advantageously provide a reflection-type x-ray source with multiple target materials within a "sealed tube" source. By configuring the x-ray source to use an electron beam to irradiate a selected target material of the multiple target materials, with each target material generating x-rays having a corresponding x-ray spectrum with different characteristic x-ray energies, the reflection-type x-ray source can advantageously provide multiple, selectable x-ray spectra so that the x-ray source can be optimized for different applications, without having to open the x-ray source to change targets and to pump down the x-ray source each time.

Figure 1A:
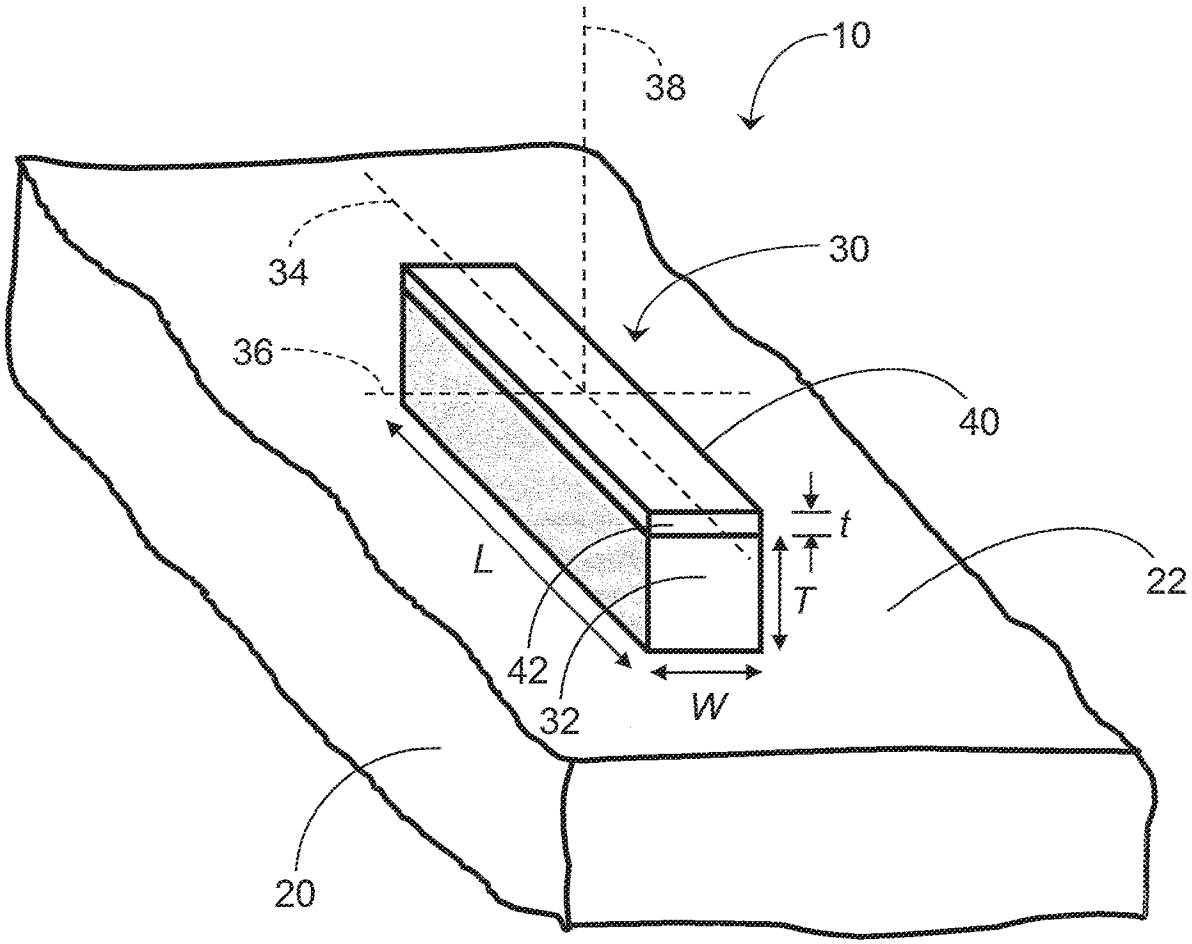
FIGS. 1A-1C schematically illustrate portions of example x-ray targets in accordance with certain embodiments described herein.
Figure 1B:
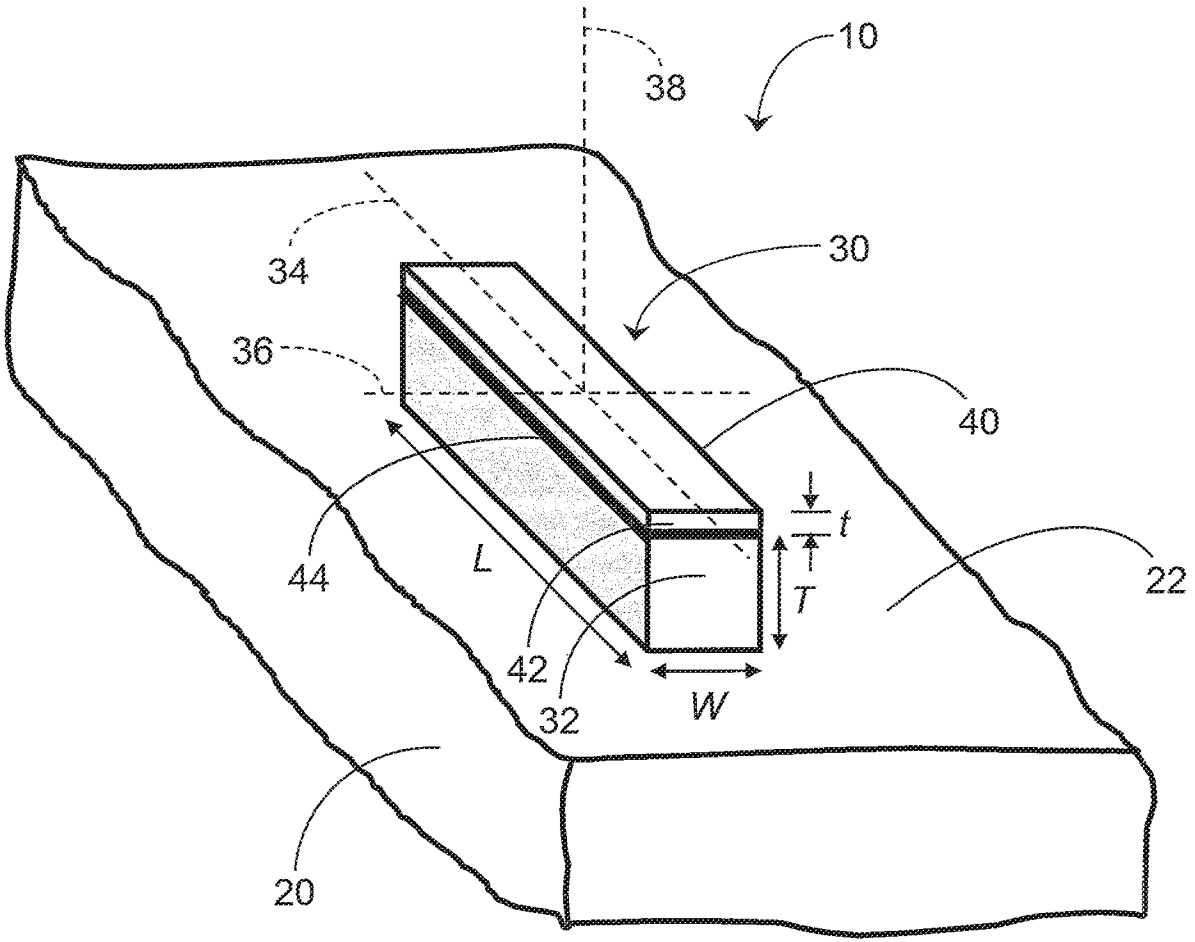
Figure 1C:
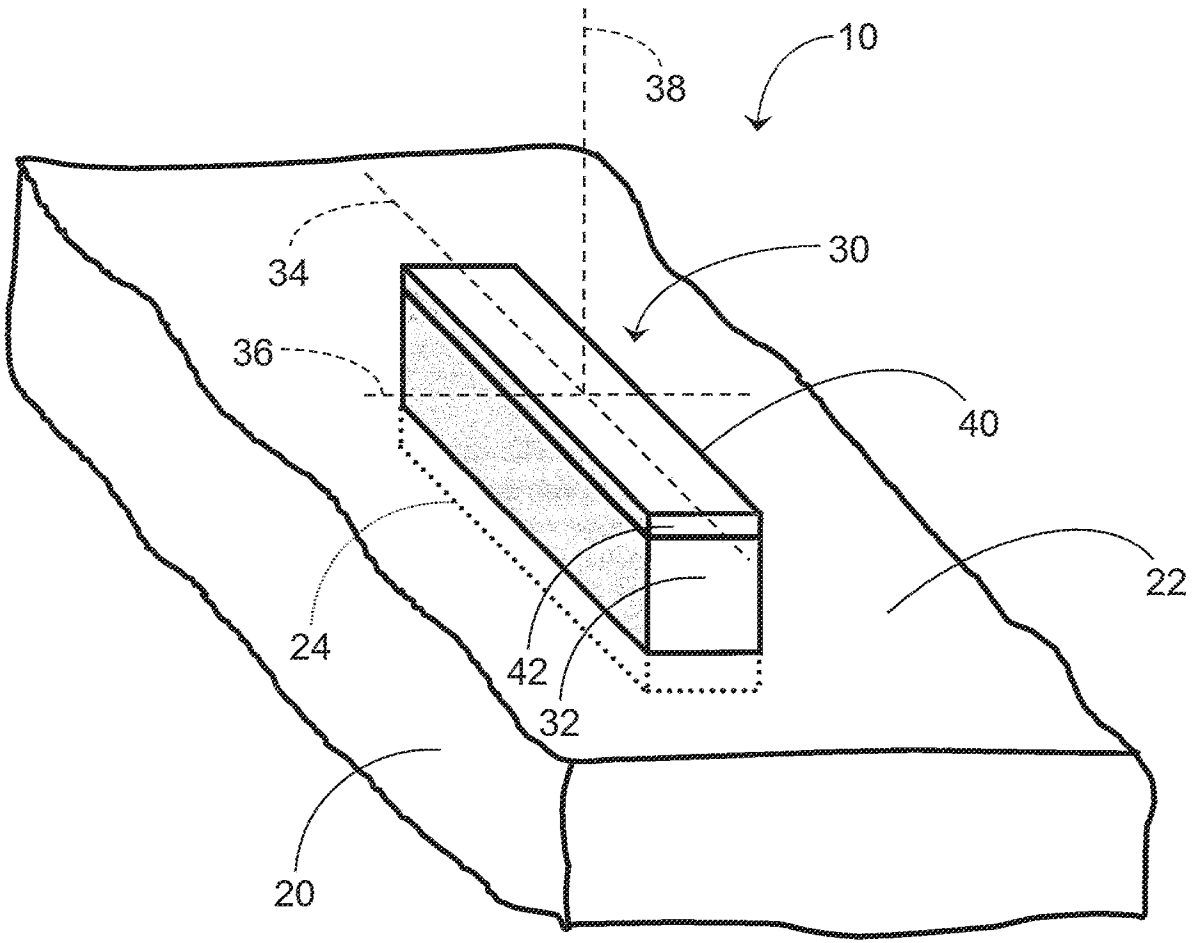

FIGS. 1A-1C schematically illustrate portions of example x-ray targets 10 in accordance with certain embodiments described herein. In each of FIGS. 1A-1C, the x-ray target 10 comprises a thermally conductive substrate 20 comprising a surface 22 and at least one structure 30 on or embedded in at least a portion of the surface 22. The at least one structure 30 comprises a thermally conductive first material 32 in thermal communication with the substrate 20. The first material 32 has a length L along a first direction 34 parallel to the portion of the surface 22, the length L in a range greater than 1 millimeter. The first material 32 also has a width W along a second direction 36 parallel to the portion of the surface 22 and perpendicular to the first direction 34, the width Win a range of 0.2 millimeter to 3 millimeters (e.g., 0.2 millimeter to 1 millimeter). The at least one structure 30 further comprises at least one layer 40 over the first material 32, the at least one layer 40 comprises at least one second material 42 different from the first material 32. The at least one layer 40 has a thickness T in a range of 1 micron to 50 microns (e.g., in a range of 1 micron to 20 microns; tungsten layer thickness in a range of 1 micron to 4 microns; copper layer thickness in a range of 2 microns to 7 microns), and the at least one second material 42 is configured to generate x-rays upon irradiation by electrons having energies in an energy range of 0.5 keV to 160 keV.

In certain embodiments, the target 10 is configured to transfer heat away from the at least one structure 30. For example, the surface 22 of the substrate 20 can comprise at least one thermally conductive material and the remaining portion of the substrate 20 can comprise the same at least one thermally conductive material and/or another one or more thermally conductive materials. Examples of the at least one thermally conductive material include but are not limited to, metals (e.g., copper; beryllium; doped graphite), metal alloys, metal composites, and electrically insulating but thermally conducting materials (e.g., diamond; graphite; diamond-like carbon; silicon; boron nitride; silicon carbide; sapphire). In certain embodiments, the at least one thermally conductive material has a thermal conductivity in a range between 20 W/m-K and 2500 W/m-K (e.g., between 150 W/m-K and 2500 W/m-K; between 200 W/m-K and 2500 W/m-K; between 2000 W/m-K and 2500 W/m-K) and comprises elements with atomic numbers less than or equal to 14. The surface 22 of the substrate 20 is electrically conductive in certain embodiments and is configured to be in electrical communication with an electrical potential (e.g., electrical ground) and is configured to prevent charging of the surface 22 due to electron irradiation of the target 10. In certain embodiments, the target 10 comprises a heat transfer structure in thermal communication with the substrate 20 and configured to transfer heat away from the target 10. Examples of heat transfer structures include but are not limited to, heat sinks, heat pipes, and fluid flow conduits configured to have a fluid coolant (e.g., liquid; water; deionized water; air; refrigerant; heat transfer fluid such as Galden® Perfluoropolyether fluorinated fluids marketed by Solvay S.A. of Brussels, Belgium) flow therethrough and to transfer heat away from the substrate 20 (e.g., at a rate similar to the power loading rate of the target 10 from the electron irradiation).

In certain embodiments, the thermally conductive first material 32 is configured to be adhered (e.g., joined; fixed; brazed; soldered) to the surface 22 of the substrate 20, such that the first material 32 is in thermal communication with the substrate 20. For example, the first material 32 can be soldered or brazed onto the surface 22 with a thermally conductive soldering or brazing material, examples of which include but are not limited to: CuSil-ABA® or Nioro® brazing alloys marketed by Morgan Advanced Materials of Windsor, Berkshire, United Kingdom; gold/copper braze alloys. As schematically illustrated in FIGS. 1A and 1B, in certain embodiments, the first material 32 is on the surface 22 and is adhered to the surface 22 by a soldering or brazing material (not shown) extending along at least a portion of the first material 32 and mechanically coupled to both the first material 32 and the surface 22. The soldering or brazing material can enhance (e.g., improve; facilitate) the thermal conductivity between the first material 32 and the surface 22. In certain other embodiments, the first material 32 is over the surface 22 with soldering or brazing material extending along at least a portion of the first material 32 and between the first material 32 and the surface 22, mechanically coupled to both the first material 32 and the surface 22, and enhancing (e.g., improving; facilitating) the thermal conductivity between the first material 32 and the surface 22. In certain embodiments, as schematically illustrated by FIG. 1C, the surface 22 comprises a recess 24 configured to have the first material 32 inserted partially into the recess 24 such that the structure 30 is embedded in at least a portion of the surface 22. The first material 32 can be adhered to the surface 22 by soldering or brazing material (not shown) extending along at least a portion of the first material 32, mechanically coupled to both the first material 32 and the surface 22, and enhancing (e.g., improving; facilitating) the thermal conductivity between the first material 32 and the surface 22.

Examples of the first material 32 include but are not limited to, at least one of: diamond, silicon carbide, beryllium, and sapphire. While FIG. 1A schematically illustrates the first material 32 having a half-cylinder, prism, or parallelepiped shape (e.g., ribbon; bar; strip; strut; finger; slab; plate) having substantially straight sides, any other shape (e.g., regular; irregular; geometric; non-geometric) with straight, curved, and/or irregular sides is also compatible with certain embodiments described herein. In certain embodiments, the length L of the first material 32 is the largest extent of the first material 32 in the first direction 34, and the width W of the first material 32 is the largest extent of the first material 32 in the second direction 36. The length L can be in a range greater than 1 millimeter, greater than 5 millimeters, 1 millimeter to 4 millimeters, 1 millimeter to 10 millimeters, or 1 millimeter to 20 millimeters. The width W can be in a range of 0.2 millimeter to 3 millimeters; 0.2 millimeter to 1 millimeter, 0.4 millimeter to 1 millimeter, 0.4 millimeter to 1 millimeter, 0.2 millimeter to 0.8 millimeter, or 0.2 millimeter to 0.6 millimeter. In certain embodiments, the thickness T of the first material 32 is the largest extent of the first material 32 in a direction perpendicular to the portion of the surface 22, and can be in a range of 0.2 millimeter to 1 millimeter, 0.4 millimeter to 1 millimeter, 0.4 millimeter to 1 millimeter, 0.2 millimeter to 0.8 millimeter, or 0.2 millimeter to 0.6 millimeter.

In certain embodiments, the at least one second material 42 of the at least one layer 40 is selected to generate x-rays having a predetermined energy spectrum (e.g., x-ray intensity distribution as function of x-ray energy) upon irradiation by electrons having energies in the energy range of 0.5 keV to 160 keV. Examples of the at least one second material 42 include but are not limited to, at least one of: tungsten, chromium, copper, aluminum, rhodium, molybdenum, gold, platinum, iridium, cobalt, tantalum, titanium, rhenium, silicon carbide, tantalum carbide, titanium carbide, boron carbide, and alloys or combinations including one or more thereof. In certain embodiments, the thickness t of the second material 42 is the largest extent of the second material 42 in the direction 38 perpendicular to the portion of the surface 22, and can be in a range of 2 microns to 50 microns, 2 microns to 20 microns, 2 microns to 15 microns, 4 microns to 15 microns, 2 microns to 10 microns, or 2 microns to 6 microns. In certain embodiments, the thickness t of the at least one second material 42 is substantially uniform across the whole area of the layer 40, while in certain other embodiments, the thickness t of the at least one second material 42 varies across the area of the layer 40 (e.g., a first end of the layer 40 has a first thickness of the at least one second material 42 and a second end of the layer 40 has a second thickness of the at least one second material 42, the second thickness larger than the first thickness).

In certain embodiments, the thickness t of the at least one second material 42 is selected as a function of the kinetic energy of the at least one electron beam irradiating the at least one structure 30. The electron penetration depth of electrons within a material is dependent on the material and the kinetic energy of the electrons, and in certain embodiments, the thickness t of the at least one second material 42 can be selected to be less than the electron penetration depth of the electrons in the at least one second material 42. For example, the continuous slowing down approximation (CSDA) can provide an estimate of the electron penetration depth for the electrons of a selected kinetic energy incident on the at least one second material 42, and the thickness t of the at least one second material 42 can be selected to be in a range of 50% to 70% of the CSDA estimate.

The at least one second material 42 in certain embodiments is configured to be in electrical communication with an electrical potential (e.g., electrical ground) and is configured to prevent charging of the at least one second material 42 due to electron irradiation. For example, electrically conductive soldering or brazing material (not shown in FIGS. 1A-1C) can be used to adhere (e.g., join; fix; braze; solder) the structure 30 to the surface 22, and at least some of this soldering or brazing material can extend from the surface 22 to the at least one second material 42 along at least a portion of one of the sides of the first material 32, thereby providing electrical conductivity between the at least one second material 42 and the surface 22.

In certain embodiments, as schematically illustrated by FIG. 1B, the at least one layer 40 further comprises at least one third material 44 between the first material 32 and the at least one second material 42, and the at least one third material 44 is different from the first material 32 and the at least one second material 42. Examples of the at least one third material 44 include but are not limited to, at least one of: titanium nitride (e.g., used with a first material 32 comprising diamond and a second material 42 comprising tungsten), iridium (e.g., used with a first material 32 comprising diamond and a second material 42 comprising molybdenum and/or tungsten), chromium (e.g., used with a first material 32 comprising diamond and a second material 42 comprising copper), beryllium (e.g., used with a first material 32 comprising diamond), and hafnium oxide. In certain embodiments, the thickness of the third material 44 is the largest extent of the second material 44 in the direction perpendicular to the portion of the surface 22, and can be in a range of 2 nanometers to 50 nanometers (e.g., 2 nanometers to 30 nanometers). In certain embodiments, the at least one third material 44 is selected to provide a diffusion barrier layer configured to avoid (e.g., prevent; reduce; inhibit) diffusion of the at least one second material 42 (e.g., tungsten) into the first material 32 (e.g., diamond). For example, a diffusion barrier layer can be graded from a carbide material at an interface with the diamond first material 32 to the at least one third material 44. In certain embodiments, the at least one third material 44 is configured to enhance (e.g., improve; facilitate) adhesion between the at least one second material 42 and the first material 32 and/or to enhance (e.g., improve; facilitate) thermal conductivity between the at least one second material 42 and the first material 32.

In certain embodiments, the length L and the width W of the first material 32 can be selected to be sufficiently small to avoid (e.g., prevent; reduce; inhibit) interfacial stress between the dissimilar first material 32 and the at least one second material 42, between the dissimilar first material 32 and the at least one third material 44, and/or between the dissimilar at least one second material 42 and the at least one third material 44. For example, each of the length L and the width W of the first material 32 can be less than 2 millimeters.

In certain embodiments, the first material 32 (e.g., diamond) can be cut (e.g., laser-cut) from a wafer or other structure (e.g., in strips). While FIGS. 1A-1C schematically illustrate certain embodiments in which the first material 32 has straight and smooth top, bottom, and side surfaces at perpendicular angles relative to one another, in certain other embodiments, the top, bottom, and/or side surfaces of the first material 32 are rough, irregular, or curved and/or are at non-perpendicular angles relative to one another. In certain embodiments, the at least one second material 42 and/or the at least one third material 44 can be deposited onto a top surface of the first material 32 (e.g., by a sputtering process such as magnetron sputtering). While FIGS. 1A-1C schematically illustrate certain embodiments in which the at least one second material 42 and the at least one third material 44 have straight and smooth top, bottom, and side surfaces and side surfaces which are flush with the sides of the first material 32, in certain other embodiments, the at least one second material 42 and/or the at least one third material 44 are rough, irregular, or curved surfaces, and/or the side surfaces extend beyond the top surface of the first material 32 (e.g., extending downward along the sides of the first material 32 below the top surface of the first material 32) and/or beyond one or more of the side surfaces of the first material 32 (e.g., extending outward in one or more directions parallel to the portion of the surface 22 such that the at least one second material 42 and/or the at least one third material 44 has a larger length and/or width than does the first material 32). While FIGS. 1A-1C schematically illustrate certain embodiments in which the top surface of the at least one second material 42 are parallel to the portion of the surface 22, in certain other embodiments, the top surface of the at least one second material 42 is non-parallel to the portion of the surface 22.

Figure 2A:
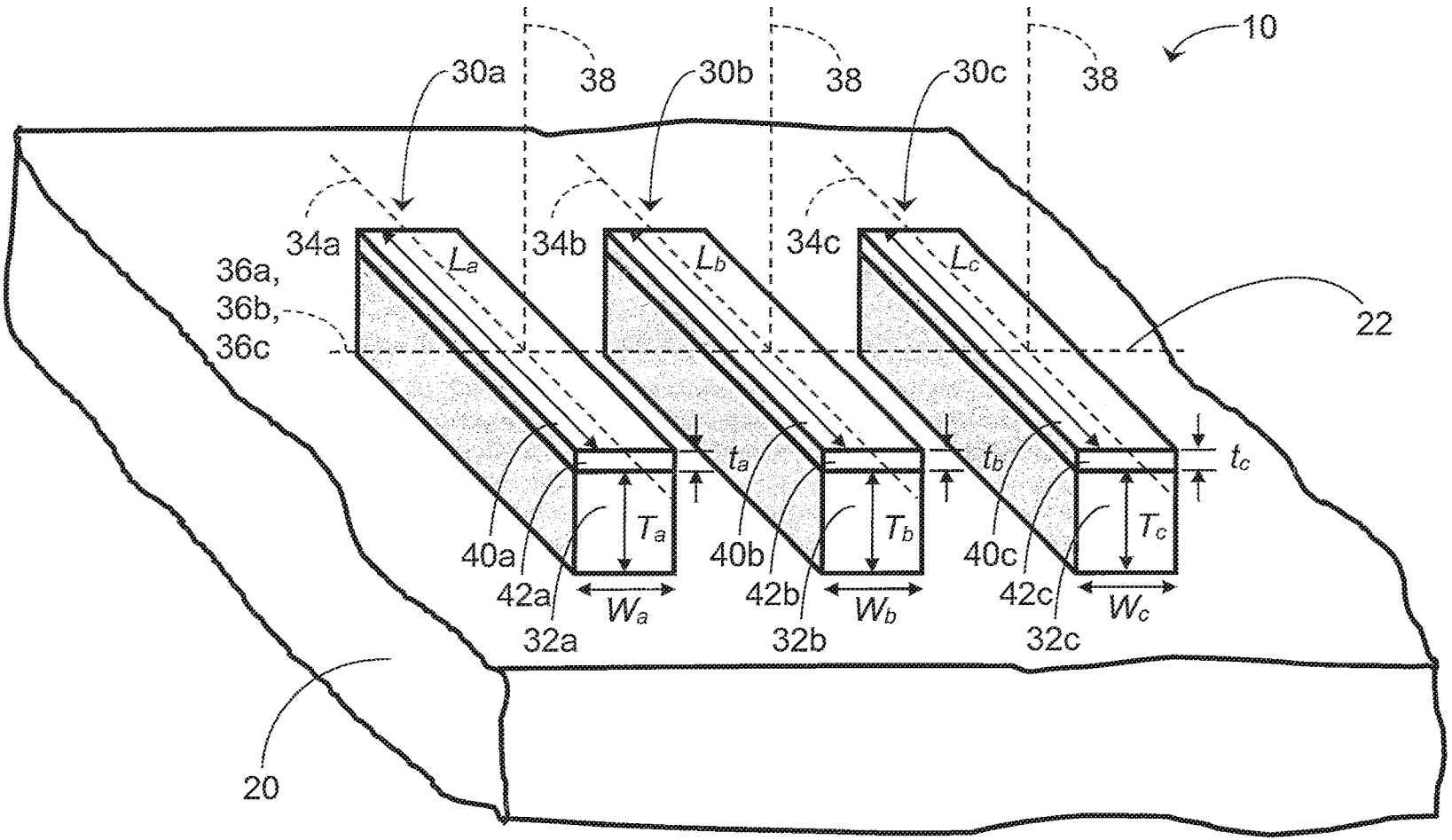
FIGS. 2A and 2B schematically illustrate portions of example x-ray targets having a plurality of structures separate from one another in accordance with certain embodiments described herein.
Figure 2B:
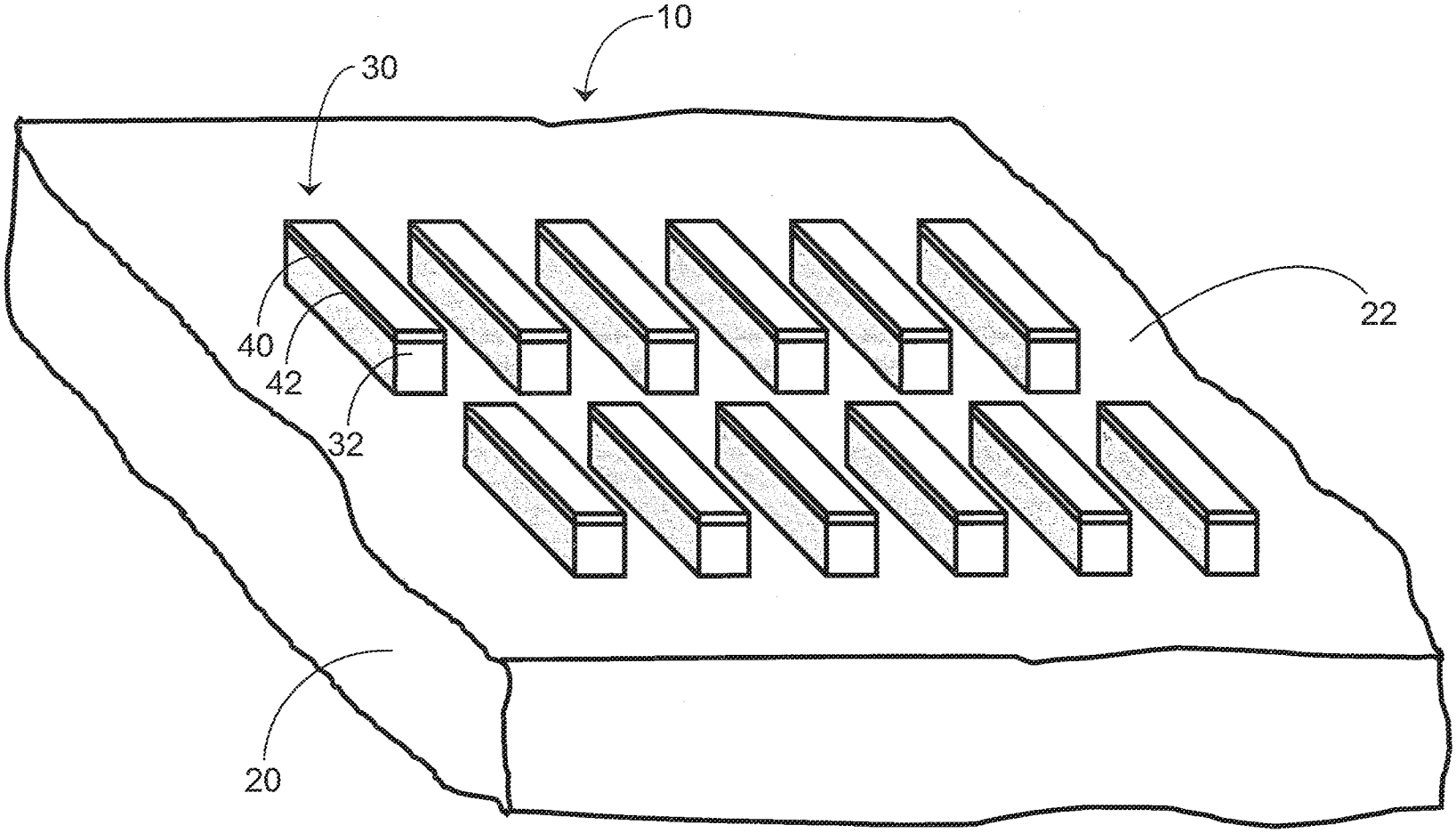

FIGS. 2A and 2B schematically illustrate portions of example x-ray targets 10 having a plurality of structures 30 separate from one another in accordance with certain embodiments described herein. In FIG. 2A, the target 10 comprises three structures 30*a*, 30*b*, 30*c* separated from one another and arranged in a linear configuration, each of which comprises a corresponding first material 32*a*, 32*b*, 32*c*, at least one corresponding layer 40*a*, 40*b*, 40*c* over the corresponding first material 32*a*, 32*b*, 32*c* and comprising at least one corresponding second material 42*a*, 42*b*, 42*c* different from the corresponding first material 32*a*, 32*b*, 32*c*. In FIG. 2B, the target 10 comprises twelve structures 30 separated from one another and arranged in a rectilinear array configuration, each of which comprises a corresponding first material 32, at least one corresponding layer 40 over the corresponding first material 32 and comprising at least one corresponding second material 42 different from the corresponding first material 32. Other numbers of structures 30 (e.g., 2, 4, 5, 6, 7, 8, 9, 10, 11, or more) are also compatible with certain embodiments described herein.

In certain embodiments, the first materials 32 of two or more of the structures 30 can be the same as one another (e.g., all the first materials 32 the same as one another), the first materials 32 of two or more of the structures 30 can be different from one another, the second materials 42 of two or more of the structures 30 can be the same as one another, and/or the second materials 42 of two or more of the structures 30 can be different from one another (e.g., all the second materials 42 different from one another). The x-rays generated by at least two of the structures 30 can have spectra (e.g., intensity distributions as functions of x-ray energy) that are different from one another (e.g., all the spectra from the different structures 30 can be different from one another). In certain embodiments, some or all of the structures 30 can comprise at least one third material 44 between the first material 32 and the second material 42, and the third materials 44 of two or more of the structures 30 can be the same as one another and/or the third materials 44 of two or more of the structures 30 can be different from one another.

In certain embodiments, each of the structures 30 has a corresponding long dimension (e.g., length $L_a$, $L_b$, $L_c$) along a first direction 34*a*, 34*b*, 34*c* parallel to the portion of the surface 22 and a corresponding short dimension (e.g., width $W_a$, $W_b$, $W_c$) along a second direction 36*a*, 36*b*, 36*c* perpendicular to the first direction 34*a*, 34*b*, 34*c* and parallel to the portion of the surface 22. The long dimensions of two or more of the structures 30 can be equal to one another (e.g., all the long dimensions equal to one another), the long dimensions of two or more of the structures 30 can be non-equal to one another, the short dimensions of two or more of the structures 30 can be equal to one another (e.g., all the short dimensions equal to one another), and/or the short dimensions of two or more of the structures can be non-equal to one another. In certain embodiments, each of the layers 40 has a corresponding thickness (e.g., $t_a$, $t_b$, $t_c$) in a direction 38 perpendicular to the portion of the surface 22. The thicknesses of two or more of the structures 30 can be equal to one another (e.g., all the thicknesses equal to one another) and/or the thicknesses of two or more of the structures 30 can be non-equal to one another (e.g., all the thicknesses non-equal to one another). Adjacent structures 30 of certain embodiments are spaced from one another by separation distances in a direction parallel to the portion of the surface 22, and the separation distances are in a range greater than 0.02 millimeter, 0.02 millimeter to 4 millimeters, 0.2 millimeter to 4 millimeters, 0.4 millimeter to 2 millimeters, 0.4 millimeter to 1 millimeter, or 1 millimeter to 4 millimeters. The separation distance between a first two adjacent structures 30 and the separation distance between a second two adjacent structures 30 can be equal to one another or non-equal to one another.

As schematically illustrated in FIG. 2A, the example structures 30 are arranged in a linear configuration, with the structures 30 aligned with one another (e.g., having their long dimensions along first directions 34*a*, 34*b*, 34*c* that are parallel to one another and their short dimensions along second directions 36*a*, 36*b*, 36*c* parallel to and/or coincident with one another). In certain other embodiments, the structures 30 are not aligned with one another (e.g., having their long dimensions along first directions 34*a*, 34*b*, 34*c* that are non-parallel to one another and/or their short dimensions along second directions 36*a*, 36*b*, 36*c* non-parallel to and/or non-coincident with one another). As schematically illustrated in FIG. 2B, the example structures 30 are arranged in a rectilinear array configuration, with a first set of structures 30 aligned with one another (e.g., having their long dimensions along first directions 34 that are parallel to one another and their short dimensions along second directions 36 parallel and/or coincident with one another) and a second set of structures 30 aligned with one another and with the first set of structures 30 (e.g., having their long dimensions along first directions 34 parallel to and/or coincident with the long dimensions of the first set of structures 30). In certain other embodiments, the structures 30 of the array are not aligned with one another (e.g., non-parallel to and/or non-coincident long dimensions and/or short dimensions). Various other arrangements of the arrays of structures 30 are also compatible with certain embodiments described herein (e.g., non-rectilinear; non-aligned; non-equal separation distances; etc.). For example, a first set of the structures 30 can have a first periodicity and a second set of the structures 30 can have a second periodicity different from the first periodicity (e.g., different in one or two directions parallel to the portion of the surface 22). For another example, one or both of the first set and the second set can be non-periodic (e.g., in one or two directions parallel to the portion of the surface 22).

Figure 3:
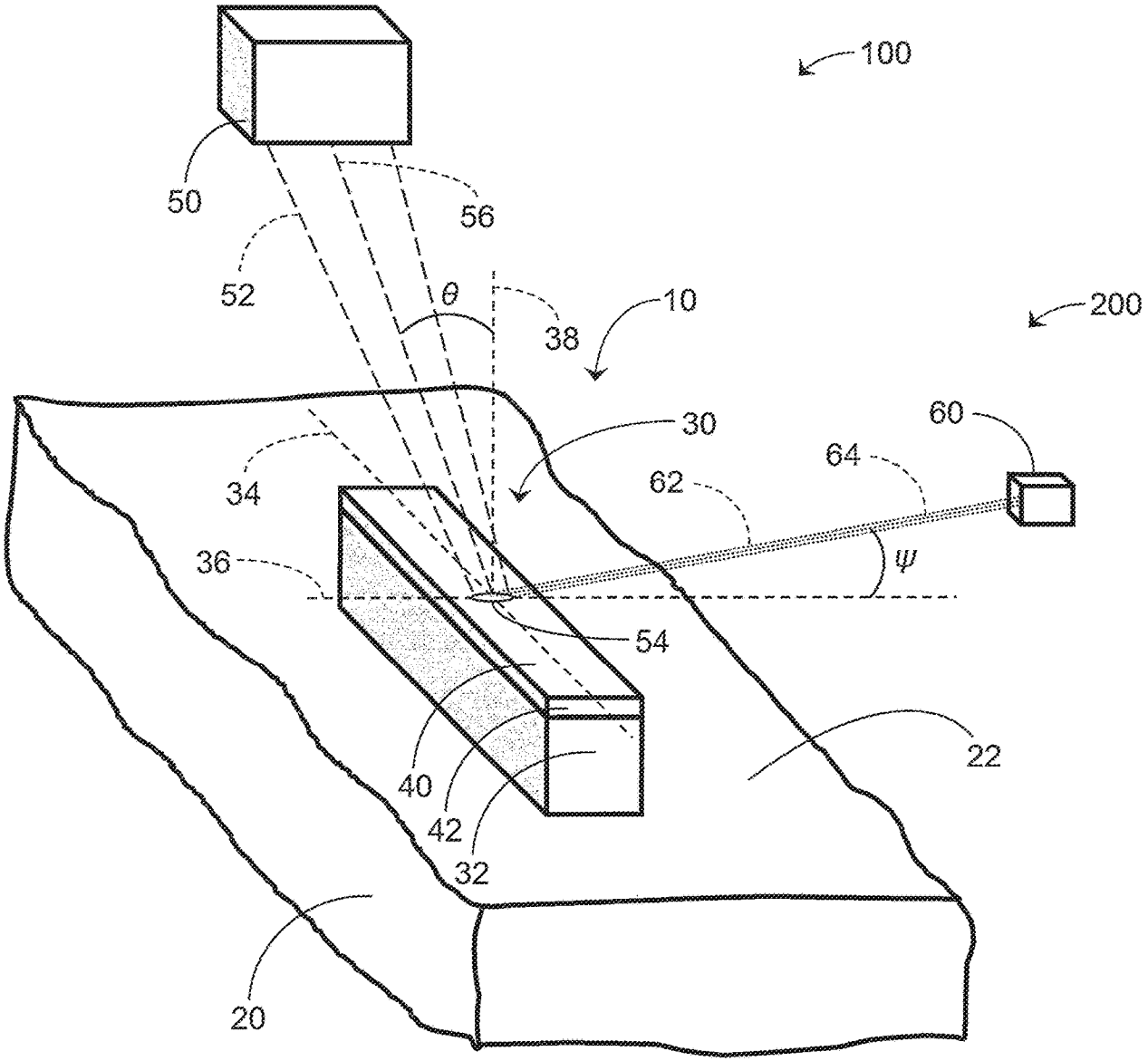
FIG. 3 schematically illustrates an example x-ray source of an example x-ray system in accordance with certain embodiments described herein.

FIG. 3 schematically illustrates an example x-ray source 100 of an example x-ray system 200 in accordance with certain embodiments described herein. The x-ray source 100 comprises an x-ray target 10 as described herein and an electron source 50 configured to generate electrons in at least one electron beam 52 and to direct the at least one electron beam 52 to impinge the at least one structure 30 of the x-ray target 10 in an electron beam spot 54 having a spot size. The electron source 50 can comprise an electron emitter having a dispenser cathode (e.g., comprising tungsten or lanthanum hexaboride) configured to emit electrons (e.g., via thermionic or field emission) to be directed to impinge the at least one structure 30. The dispenser cathode of certain embodiments has an aspect ratio equal to an aspect ratio of the electron beam spot 54 impinging the at least one structure 30. Example dispenser cathodes in accordance with certain embodiments described herein are marketed by Spectra-Mat, Inc. of Watsonville, Calif. (e.g., thermionic emitters comprising a porous tungsten matrix impregnated with barium aluminate).

The electron source 50 further comprises electron optics components (e.g., deflection electrodes; grids; etc.) configured to receive the electrons emitted from the electron emitter, to accelerate the electrons to a predetermined electron kinetic energy (e.g., in a range of 0.5 keV to 160 keV), to form (e.g., shape and/or focus) the at least one electron beam 52, and to direct the at least one electron beam 52 onto the target 10. Example configurations of electron optics components in accordance with certain embodiments described herein include but are not limited to, two-grid configurations and three-grid configurations. In certain embodiments, the x-ray target 10 is configured to be used as an anode (e.g., set at a positive voltage relative to the electron source 50) to accelerate and/or otherwise modify the electron beam 52.

In certain embodiments, the kinetic energy of the at least one electron beam 52 is selected such that the electron penetration depth of the electrons of the at least one electron beam 52 within the at least one second material 42 is greater than the thickness t of the at least one second material 42. For example, the kinetic energy of the at least one electron beam 52 can be selected to correspond to a CSDA estimate of the electron penetration depth that is greater than the thickness t of the at least one second material 42 (e.g., a CSDA estimate of the electron penetration depth that is in a range of 1.5× to 2× of the thickness t of the at least one second material 42).

In certain embodiments, the electron source 50 is positioned relative to the x-ray source 10 such that a center of the at least one electron beam 52 impinges the at least one structure 30 at a non-zero angle θ (e.g., impact angle) relative to the direction 38 perpendicular to the portion of the surface 22 or to the at least one layer 40 of the structure 30 greater than 20 degrees (e.g., in a range of 20 degrees to 50 degrees; in a range of 30 degrees to 60 degrees; in a range of 40 degrees to 70 degrees). The center line 56 of the at least one electron beam 52 can be in a plane defined by the direction 38 and the first direction 34, in a plane defined by the direction 38 and the second direction 36, or in another plane substantially perpendicular to the portion of the surface 22. The at least one electron beam 52 can have a rectangular-type beam profile, an oval-type beam profile, or another type of beam profile.

In certain embodiments, as schematically illustrated in FIG. 3, the at least one electron beam 52 is focused onto the at least one layer 40 of the at least one structure 30 such that the electron beam spot 54 has a full-width-at-half maximum spot size (e.g., width of the region of the electron beam spot 54 at which the at least one electron beam 52 has an intensity of at least one-half of the maximum intensity of the at least one electron beam 52) on the at least one structure 30 that is smaller than the smallest dimension of the layer 40 in a direction parallel to the portion of the surface 22. For example, the full-width-at-half maximum spot size of the electron beam spot 54 on the at least one structure 30 can have a maximum width in a direction parallel to the portion of the surface 22 of 100 microns or less, 75 microns or less, 50 microns or less, 30 microns or less, or 15 microns or less. In certain embodiments, the full-width-at-half maximum spot size has a first dimension in a direction parallel to the portion of the surface 22 (e.g., in the first direction 34) in a range of 5 microns to 20 microns and a second dimension in another direction (e.g., in the second direction 36) perpendicular to the direction and parallel to the portion of the surface 22 in a range of 20 microns to 200 microns (e.g., the second dimension is in a range of 4× to 10× of the first dimension; the electron beam spot 54 having an aspect ratio in a range of 4:1 to 10:1).

In certain embodiments, an x-ray system 200 comprises the x-ray source 100 as described herein and at least one x-ray optic 60 configured to receive x-rays 62 from the x-ray source 100 propagating along a propagation direction having a take-off angle ψ (e.g., angle of a center line 64 of an acceptance cone of the at least one x-ray optic 60, the angle defined relative to a direction parallel to the portion of the surface 22) in a range of 0 degrees to 40 degrees (e.g., in a range of 0 degrees to 3 degrees; in a range of 2 degrees to 5 degrees; in a range of 4 degrees to 6 degrees; in a range of 5 degrees to 10 degrees). For example, the at least one x-ray optic 60 can be configured to receive x-rays 62 emitted from the x-ray source 100 (e.g., through a window substantially transparent to the x-rays 62) and the take-off angle ψ can be in a plane perpendicular to the plane defined by the center line 56 of the electron beam 52 and the direction 38. In certain embodiments, the take-off angle ψ is selected such that the electron beam spot 54, when viewed along the center line 64 at the take-off angle ψ, is foreshortened (e.g., to appear to be substantially symmetric; to appear to have an aspect ratio of 1:1). For example, the focal spot from which x-rays 62 are collected by the at least one x-ray optic 60 can have a full-width-at-half maximum focal spot size (e.g., width of the region of the focal spot at which the x-rays 62 have an intensity of at least one-half of the maximum intensity of the x-rays 62) that is less than 20 microns, less than 15 microns, or less than 10 microns.

Various configurations of the at least one x-ray optic 60 and the x-ray system 200 are compatible with certain embodiments described herein. For example, the at least one x-ray optic 60 can comprise at least one of a polycapillary-type or single capillary-type optic, with an inner reflecting surface having a shape of one or more portions of a quadric function (e.g., portion of an ellipsoid and/or portions of mirrored paraboloids facing one another). The x-ray system 200 can comprise multiple x-ray optics 60, each optimized for efficiency for a specific x-ray energy of interest, and can be configured to selectively receive x-rays 62 from the x-ray target 10 (e.g., each x-ray optic 60 paired with a corresponding structure 30 of the x-ray target 10). Various example x-ray optics 60 and x-ray systems 200 with which the x-ray source 100 disclosed herein can be used in accordance with certain embodiments described herein are disclosed in U.S. Pat. Nos. 9,570,265, 9,823,203, 10,295,486, and 10,295,485, each of which is incorporated in its entirety by reference herein.

Figure 4A:
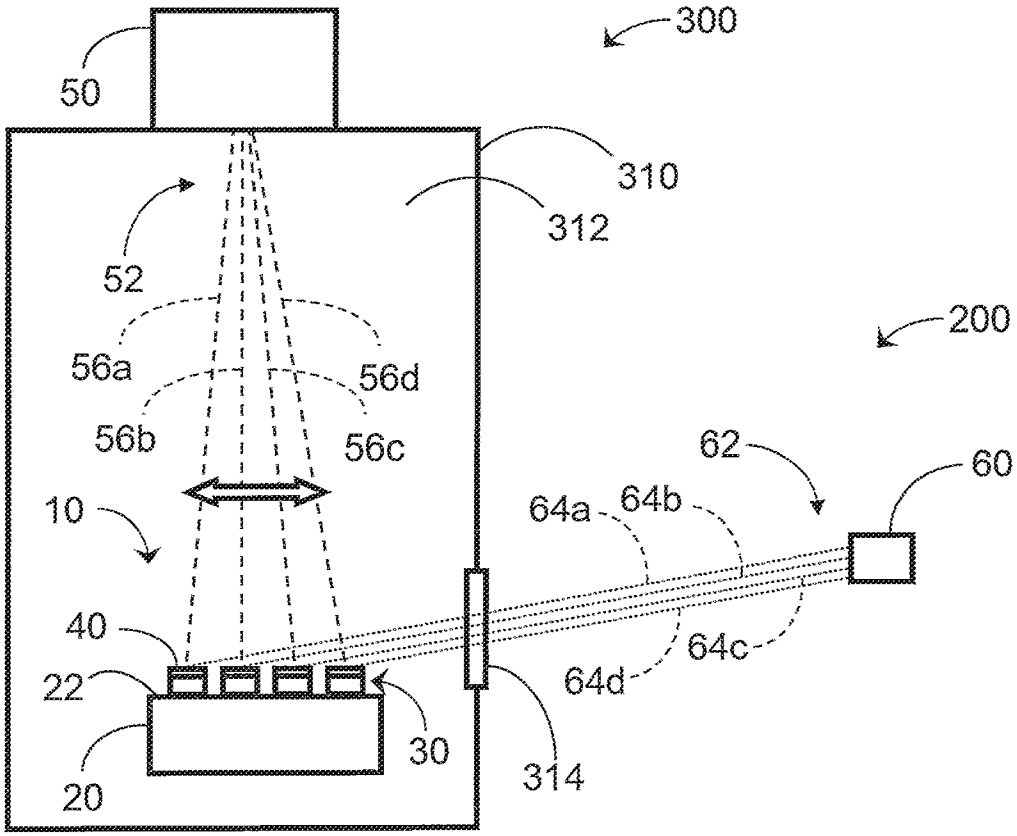
FIGS. 4A and 4B schematically illustrate other examples of an x-ray source in accordance with certain embodiments described herein.
Figure 4B:
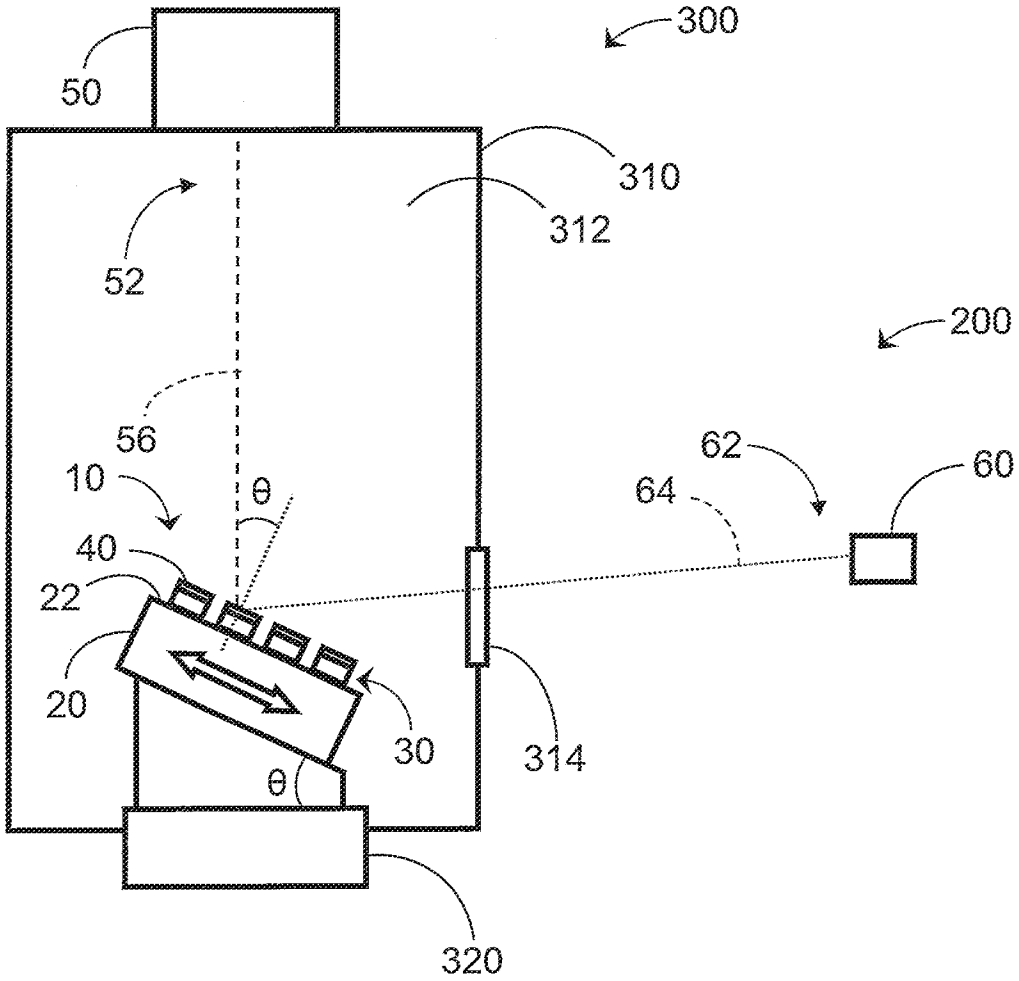

FIGS. 4A and 4B schematically illustrate other examples of an x-ray source 300 in accordance with certain embodiments described herein. The x-ray source 300 comprises an x-ray target 10 comprising a thermally conductive substrate 20 comprising a surface 22 and at least one structure 30 on or embedded in at least a portion of the surface 22 of the substrate 20 (see, e.g., FIGS. 1A-1C and 2A-2B). The x-ray source 300 further comprises an electron source 50 (see, e.g., FIG. 3) and a housing 310 containing a region 312 under vacuum (e.g., having a gas pressure less than 1 Torr) and sealed from the atmosphere surrounding the housing 310. The region 312 contains the at least one structure 30 and the at least one electron beam 52 from the electron source 50 is configured to propagate through a portion of the region 312 and impinge a selected one of the at least one structure 30.

In certain embodiments, the at least one structure 30 comprises a plurality of structures 30 separate from one another (see, e.g., FIGS. 2A-2B) and at least one of the target 10 and the at least one electron beam 52 is configured to be controllably moved to impinge a selected one of the plurality of structures 30 with the at least one electron beam 52 while the plurality of structures 30 remain in the sealed region 312. As described herein with regard to FIGS. 2A-2B, the second materials 42 of two or more of the structures 30 can be different from one another (e.g., all the second materials 42 different from one another) such that the x-rays generated by at least two of the structures 30 can have spectra that are different from one another (e.g., all the spectra can be different from one another), thereby advantageously providing an ability to select among different x-ray spectra. In addition, as described herein with regard to FIGS. 2A-2B, the second materials 42 of two or more of the structures 30 can be the same as one another, thereby advantageously providing a redundancy (e.g., in the event that one of the structures 30 is damaged or degraded, another one of the structures 30 can be used instead). While FIGS. 4A and 4B schematically illustrate the structures 30 oriented with their long dimensions along the first directions 34*a*, 34*b*, 34*c* perpendicular to the direction towards the at least one x-ray optic 60, one or more (e.g., all) of the structures 30 can alternatively have any other orientation relative to the direction towards the at least one x-ray optic 60 (e.g., in a plane defined by the direction towards the at least one x-ray optic 60 and the direction of trajectory of the at least one electron beam 52). The at least one electron beam 52 can impinge the structures 30 in a direction perpendicular to the surface 22 or to the at least one layer 40 of the structure 30 (e.g., an impact angle of 0 degrees), as schematically illustrated in FIG. 4A, or in a direction at a non-zero impact angle θ (e.g., in a range of 10 degrees to 80 degrees; in a range of 10 degrees to 30 degrees; in a range of 20 degrees to 40 degrees; in a range of 30 degrees to 50 degrees; in a range of 40 degrees to 60 degrees; in a range of 50 degrees to 70 degrees; in a range of 60 degrees to 80 degrees; in a range greater than 70 degrees) relative to a direction perpendicular to the surface 22 or to the at least one layer 40 of the structure 30.

As schematically illustrated in FIG. 4A, the electron source 50 is configured to selectively direct (e.g., deflect) the at least one electron beam 52 along a selected trajectory to impinge a selected one of the plurality of structures 30 (e.g., utilizing electron optics components, such as deflection electrodes). As shown in FIG. 4A, the x-ray target 10 can be oriented such that the at least one electron beam 52 impinges the structures 30 in a direction perpendicular to the surface 22 or to the at least one layer 40 of the structure 30. In FIG. 4A, the movement of the at least one electron beam 52 is schematically indicated by the double-headed arrow and each of the trajectories of the at least one electron beam 52 corresponding to the at least one electron beam 52 impinging a selected one of the plurality of structures 30 is schematically indicated by a corresponding center line 56*a*, 56*b*, 56*c*, 56*d* of the at least one electron beam 52. The x-rays 62 emitted from the irradiated structure 30 and transmitted through an x-ray transparent window 314 of the housing 310 are collected by the at least one x-ray optic 60. In FIG. 4A, each of the trajectories of the collected x-rays 62 corresponding to the at least one electron beam 52 impinging a selected one of the plurality of structures 30 is schematically indicated by a corresponding center line 64*a*, 64*b*, 64*c*, 64*d* of the x-rays 62. In certain embodiments, the position and/or orientation of the at least one x-ray optic 60 can be adjusted to account for the focal spot of the x-rays 62 being at different positions.

As schematically illustrated in FIG. 4B, the x-ray source 300 further comprises a stage 320 configured to move the x-ray target 10 relative to the electron source 50 such that a selected one of the plurality of structures 30 is impinged by the at least one electron beam 52. As shown in FIG. 4B, the x-ray target 10 can be oriented such that the at least one electron beam 52 impinges the structures 30 at a non-zero impact angle θ relative to a direction perpendicular to the surface 22 or to the at least one layer 40 of the structure 30. In FIG. 4B, a translation of the target 10 by the stage 320 along a direction parallel to the surface 22 of the substrate 20 is schematically indicated by the double-headed arrow. The stage 320 of certain embodiments can translate the structures 30 in one direction, in two directions (e.g., perpendicular to one another), in three directions (e.g., three directions perpendicular to one another), and/or can rotate the x-ray target 10 about one or more axes of rotation (e.g., two or more axes perpendicular to one another). In certain embodiments, one or more of the directions of translation of the target 10 by the stage 320 can be in a direction perpendicular to the at least one electron beam 42. In certain embodiments, the stage 320 comprises components (e.g., actuators; sensors) that are within the region 312 other components (e.g., computer controller; feedthroughs; motor) that are at least partially outside the region 312. The stage 320 has a sufficient amount of movement to place each of the structures 30 in position to be impinged by the at least one electron beam 52.

The x-rays 62 emitted from the irradiated structure 30 and transmitted through an x-ray transparent window 314 of the housing 310 are collected by the at least one x-ray optic 60. In certain embodiments, the position of the source of the x-rays 62 remains unchanged when selecting among the different structures 30, thereby advantageously avoiding adjustments of the position and/or orientation of the at least one x-ray optic 60 to account for different positions of the x-ray focal spot. In certain embodiments, a combination of the selectively directed electron beam 52 and the selectively movable stage 320 can be used.

While conventional sealed-tube x-ray sources typically provide focal spot sizes of about 1 millimeter and low brightness, certain embodiments described herein can provide an x-ray source that has a much smaller focal spot size and much higher brightness. Certain embodiments described herein utilize at least one electron beam 52 focused and incident onto the structure 30 with a spot size (e.g., full-width-at-half-maximum diameter) in a range of 0.5 μm to 100 μm (e.g., 2 μm; 5 μm; 10 μm; 20 μm; 50 μm), a total power in a range of 5 W to 1 kW (e.g., 10 W; 30-80 W; 100 W; 200 W), and a power density in a range of 0.2 W/μm$^2$ to 100 W/μm$^2$ (e.g., 0.3-0.8 W/μm$^2$; 2.5 W/μm$^2$; 8 W/μm$^2$; 40 W/μm$^2$) and the x-ray brightness (e.g., proportional to the electron beam power density) is in a range of $0.5\times10^{10}$ photons/mm$^2$/mrad$^2$ to $5\times10^{12}$ photons/mm$^2$/mrad$^2$ (e.g., 1-$3\times10^{10}$ photons/mm$^2$ photons/mm$^2$; $1\times10^{11}$ photons/mm$^2$/mrad$^2$; $3\times10^{11}$ photons/mm$^2$/mrad$^2$; $2\times10^{12}$ photons/mm$^2$/mrad$^2$).

In addition, by having multiple structures 30 that are selectively impinged by the at least one electron beam 52, certain embodiments described herein can provide such small focal spot sizes and higher brightnesses with the flexibility to select an x-ray spectrum from a plurality of x-ray spectra by computer-controlled movement of the at least one electron beam 52 and/or the x-ray target 10 while remaining under vacuum (e.g., without having to break vacuum, replace one x-ray target with another, and pump down to return to vacuum conditions). By moving the x-ray target 10 with 1 micron or sub-micron accuracy, certain embodiments advantageously avoid re-alignment of the at least one x-ray optic 60 and/or other components of the x-ray system 200.

By providing multiple selectable x-ray spectra, certain embodiments described herein can advantageously be used in various types of x-ray instrumentation that utilize a microfocus x-ray spot, including but not limited to: x-ray microscopy, x-ray fluorescence (XRF), x-ray diffraction (XRD), x-ray tomography; x-ray scattering (e.g., SAXS; WAXS); x-ray absorption spectroscopy (e.g., XANES; EXAFS), and x-ray emission spectroscopy.

Figure 5A:
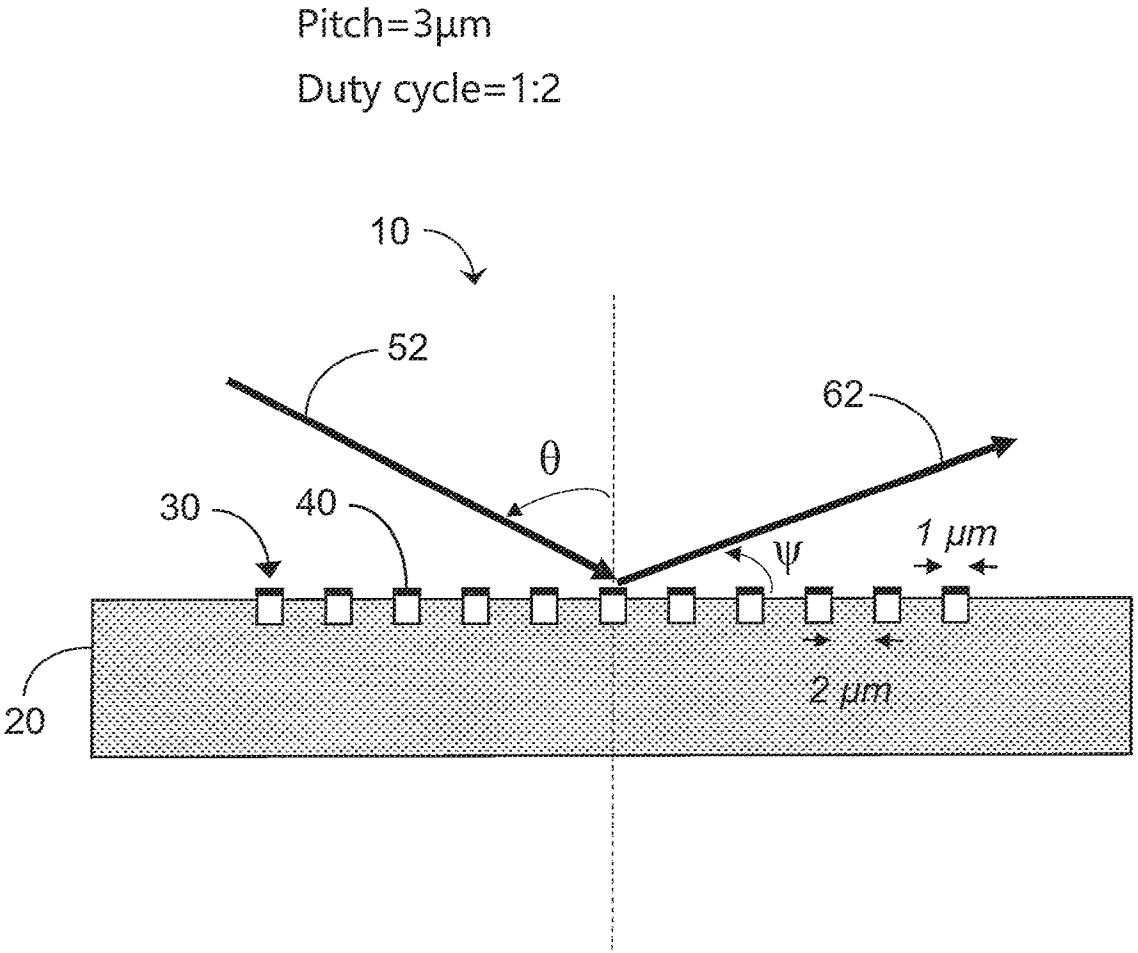
FIG. 5A schematically illustrates an example x-ray target in accordance with certain embodiments described herein, and FIGS. 5B-5I schematically illustrate various simulation results of the brightness from various versions of the example x-ray target of FIG. 5A.

FIG. 5A schematically illustrates an example x-ray target 10 with discrete structures 30 in accordance with certain embodiments described herein, and FIGS. 5B-5I schematically illustrate various simulation results of the brightness from various versions of the example x-ray target 10 of FIG. 5A in accordance with certain embodiments described herein. Each structure 30 has a metal layer 40 (e.g., tungsten; copper) on a first material 32 of diamond at least partially embedded in a copper substrate 20. FIGS. 5B-5I compare these simulation results of the brightness with those corresponding to an example conventional x-ray target having a continuous thin metal film (e.g., tungsten; copper) deposited onto a continuous diamond layer on a copper substrate. The brightness in FIGS. 5B-5I is defined as the number of photons emitted per unit area and unit solid angle per incident electron (e.g., photons/electron/$\mu m^2$/steradian).

For the simulations of FIGS. 5B, 5C, 5E, 5F, 5G, and 5I, each structure 30 has a width of 1 μm and the structures 30 are spaced from one another (e.g., between adjacent edges) by 2 μm (e.g., having a pitch of 3 μm and a duty cycle of 1:2), as shown in FIG. 5A. For the simulations of FIGS. 5D and 5H, each structure 30 has a width of 1 μm and the structures 30 are spaced from one another (e.g., between adjacent edges) by 1 μm (e.g., having a pitch of 2 μm and a duty cycle of 1:1). According to thermal modeling calculations, the x-ray target 10 of FIG. 5A can withstand an electron power density that is four times higher than on a solid copper anode for the same maximum temperature (e.g., 65 W versus 12.5 W). In the simulation results of FIGS. 5B-5I, to account for the larger fraction of scatter electrons at higher impact angles, the power of the electron beam 52 at an impact angle of 60 degrees was increased by 1.3 times as compared to an impact angle of 0 degrees.

Figure 5B:
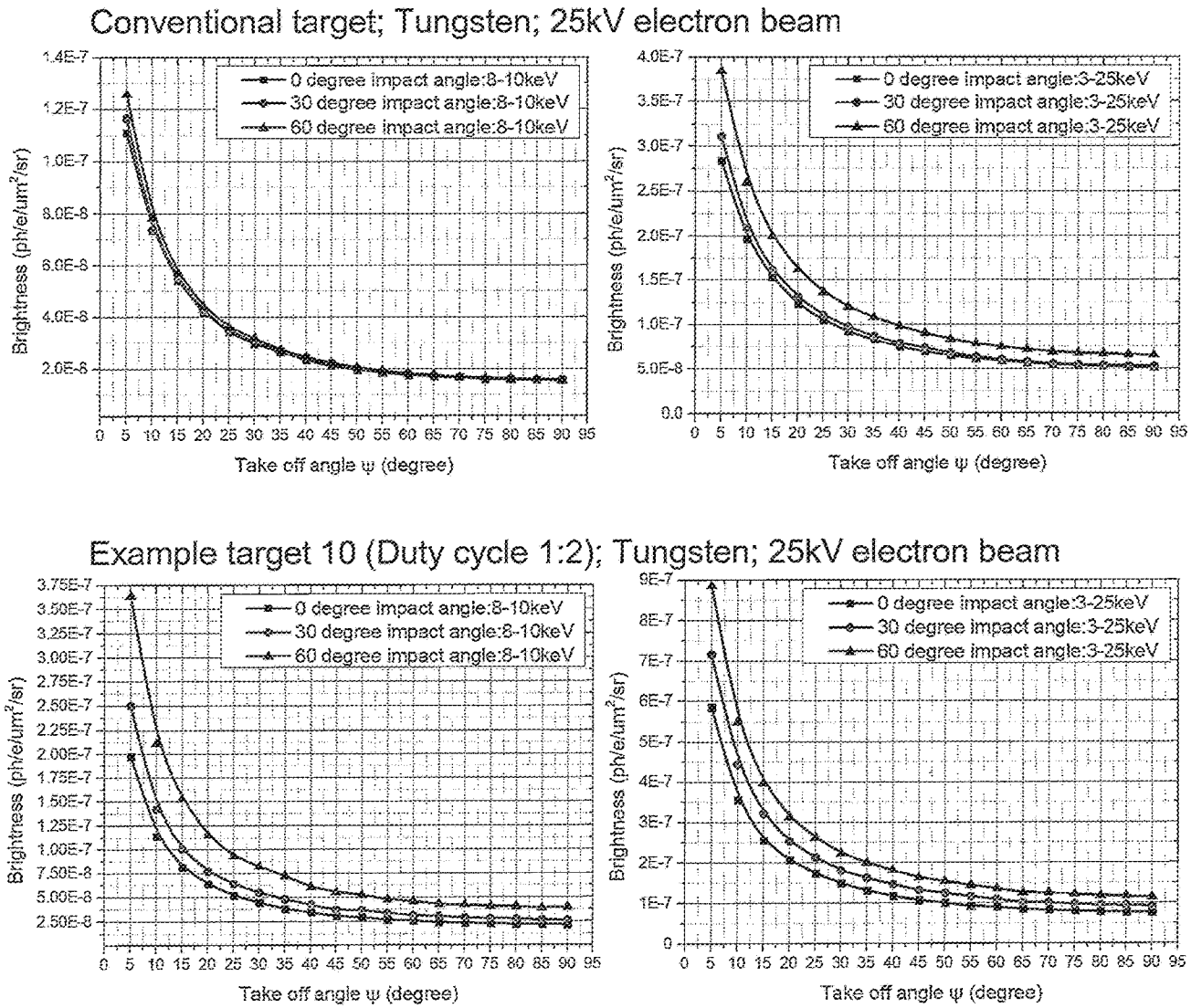

FIG. 5B compares the brightness of x-rays as a function of take-off angle and for three impact angles (0, 30, and 60 degrees) generated by a 25 kV electron beam and emitted from (i) a conventional tungsten target and (ii) an example target 10 with structures 30 with a tungsten layer 40 in accordance with certain embodiments described herein with a duty cycle of 1:2. On the left side of FIG. 5B, the brightness for x-rays having energies of 8-10 keV is shown and on the right side of FIG. 5B, the brightness for x-rays having energies of 3-25 keV is shown.

Figure 5C:
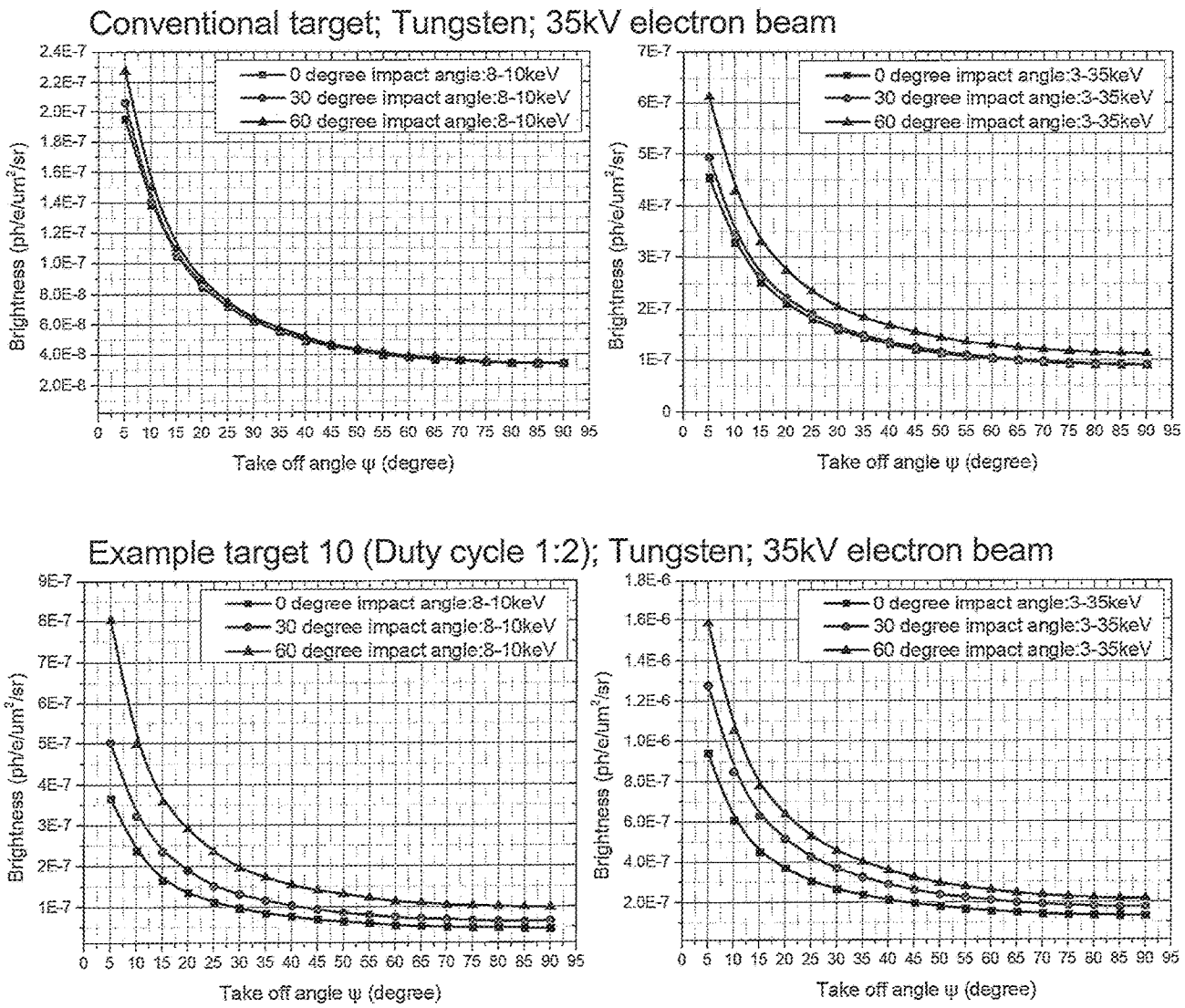

FIG. 5C compares the brightness of x-rays as a function of take-off angle and for three impact angles (0, 30, and 60 degrees) generated by a 35 kV electron beam and emitted from (i) a conventional tungsten target and (ii) an example target 10 with structures 30 with a tungsten layer 40 in accordance with certain embodiments described herein with a duty cycle of 1:2. On the left side of FIG. 5C, the brightness for x-rays having energies of 8-10 keV is shown and on the right side of FIG. 5C, the brightness for x-rays having energies of 3-35 keV is shown.

Figure 5D:
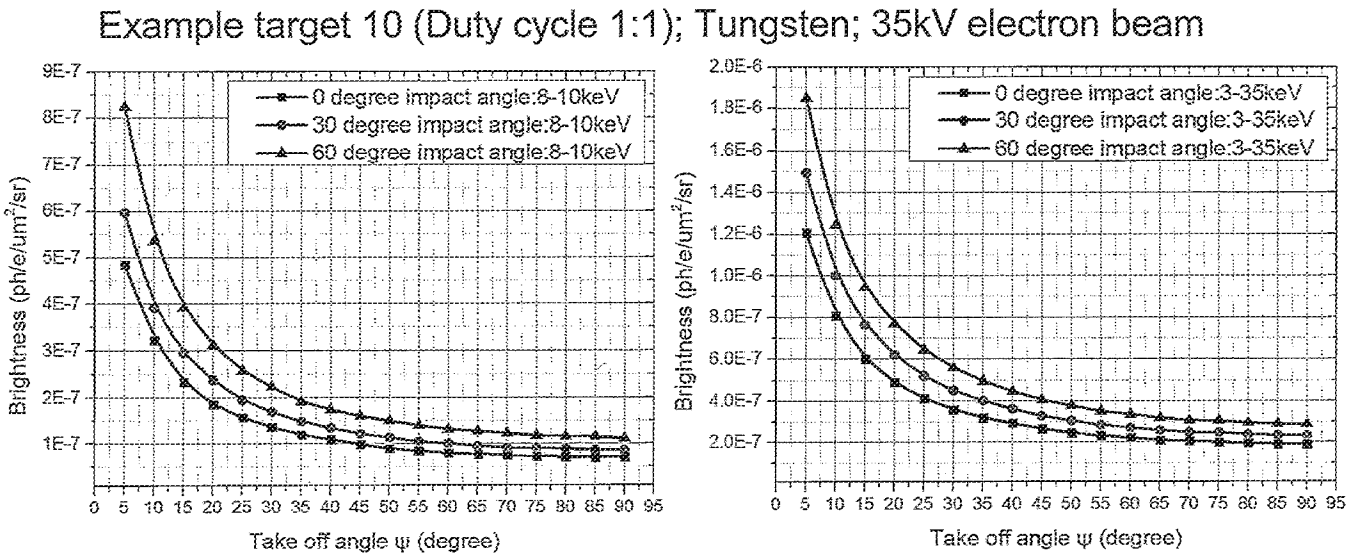

FIG. 5D shows the brightness of x-rays as a function of take-off angle and for three impact angles (0, 30, and 60 degrees) generated by a 35 kV electron beam and emitted from an example target 10 with structures 30 with a tungsten layer 40 in accordance with certain embodiments described herein with a duty cycle of 1:1. On the left side of FIG. 5D, the brightness for x-rays having energies of 8-10 keV is shown and on the right side of FIG. 5C, the brightness for x-rays having energies of 3-35 keV is shown.

Figure 5E:
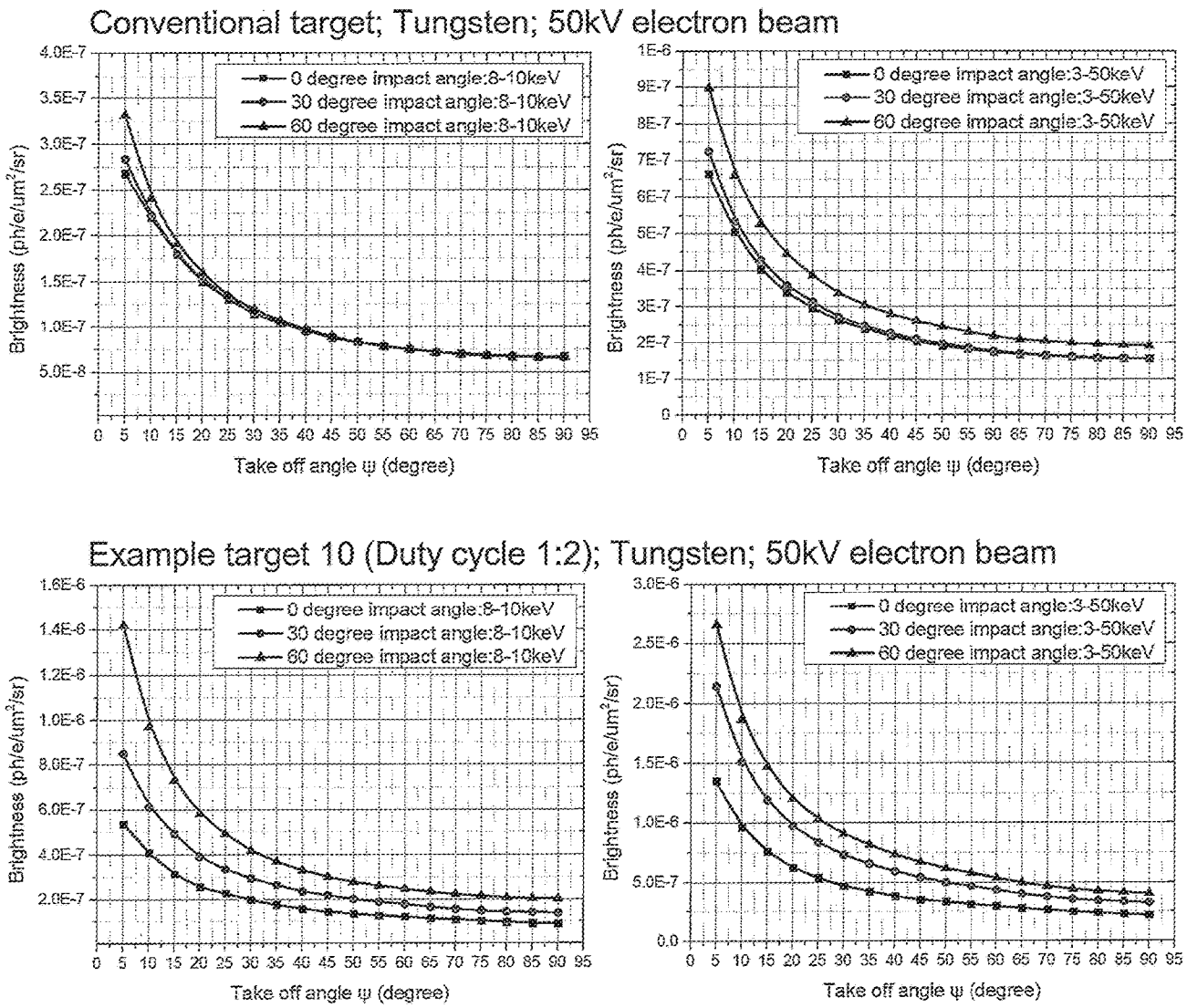

FIG. 5E compares the brightness of x-rays as a function of take-off angle and for three impact angles (0, 30, and 60 degrees) generated by a 50 kV electron beam and emitted from (i) a conventional tungsten target and (ii) an example target 10 with structures 30 with a tungsten layer 40 in accordance with certain embodiments described herein with a duty cycle of 1:2. On the left side of FIG. 5E, the brightness for x-rays having energies of 8-10 keV is shown and on the right side of FIG. 5E, the brightness for x-rays having energies of 3-50 keV is shown.

Figure 5F:
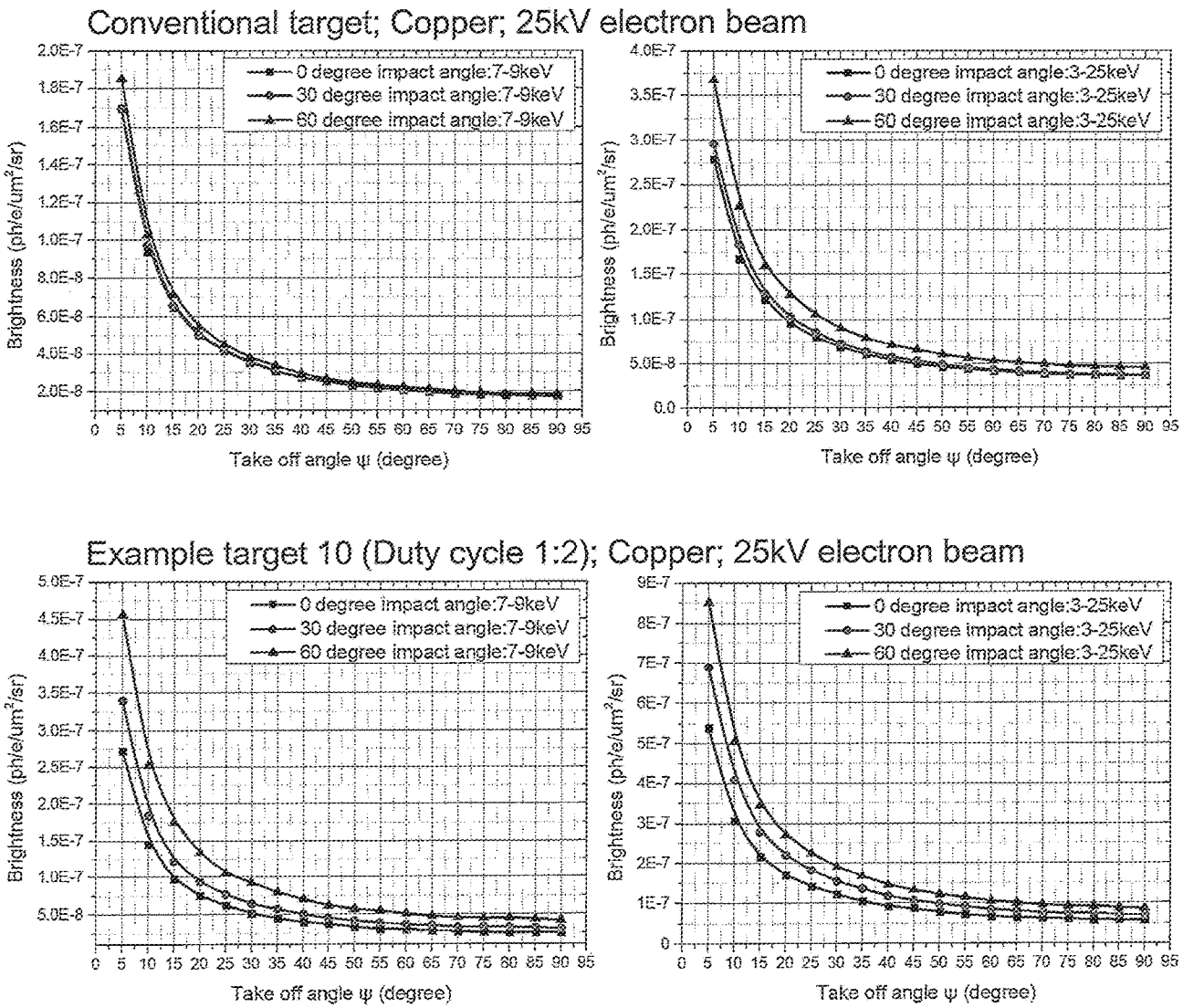

FIG. 5F compares the brightness of x-rays as a function of take-off angle and for three impact angles (0, 30, and 60 degrees) generated by a 25 kV electron beam and emitted from (i) a conventional copper target and (ii) an example target 10 with structures 30 with a copper layer 40 in accordance with certain embodiments described herein with a duty cycle of 1:2. On the left side of FIG. 5F, the brightness for x-rays having energies of 7-9 keV is shown and on the right side of FIG. 5E, the brightness for x-rays having energies of 3-25 keV is shown.

Figure 5G:
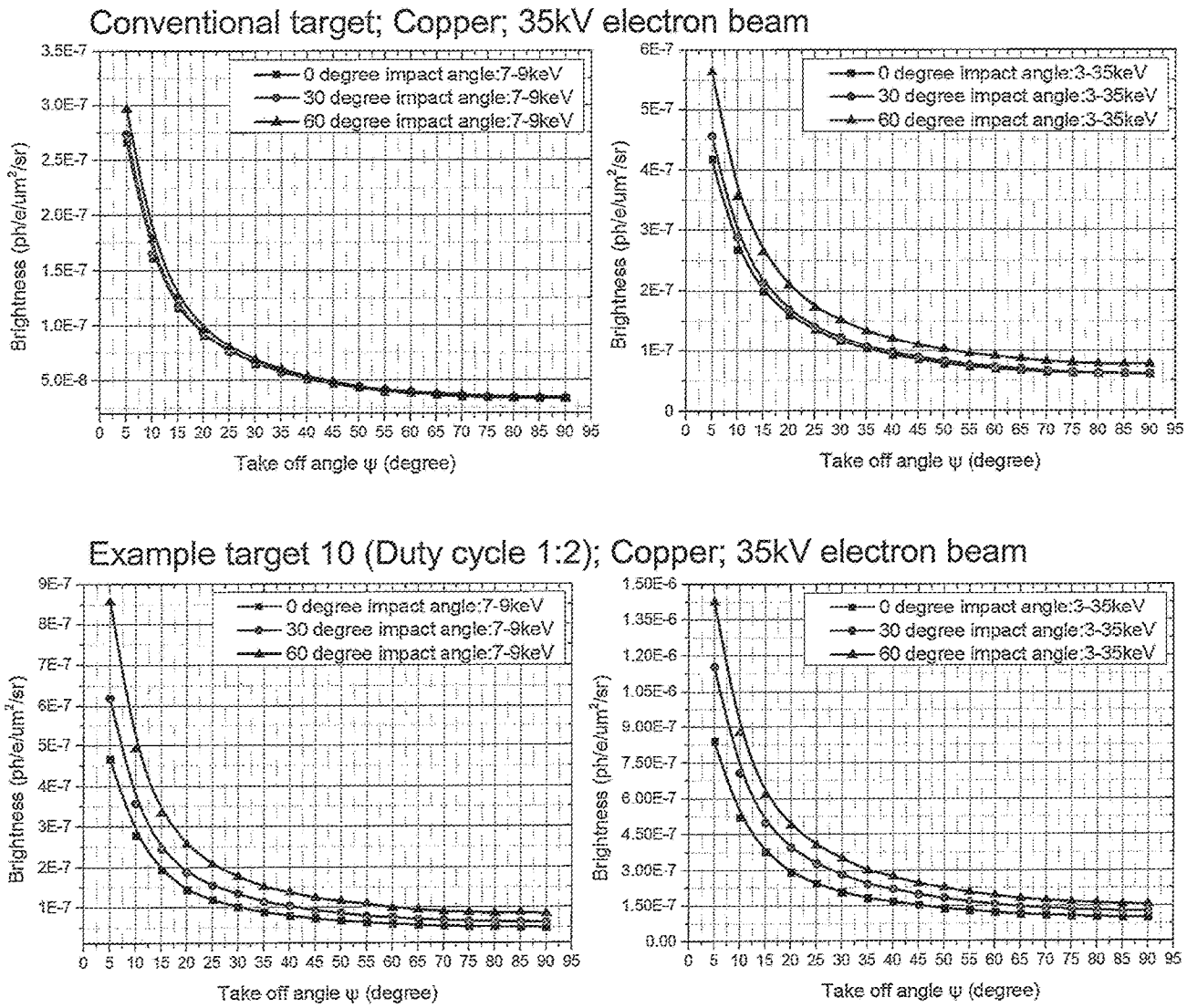

FIG. 5G compares the brightness of x-rays as a function of take-off angle and for three impact angles (0, 30, and 60 degrees) generated by a 35 kV electron beam and emitted from (i) a conventional copper target and (ii) an example target 10 with structures 30 with a copper layer 40 in accordance with certain embodiments described herein with a duty cycle of 1:2. On the left side of FIG. 5G, the brightness for x-rays having energies of 7-9 keV is shown and on the right side of FIG. 5G, the brightness for x-rays having energies of 3-35 keV is shown.

Figure 5H:
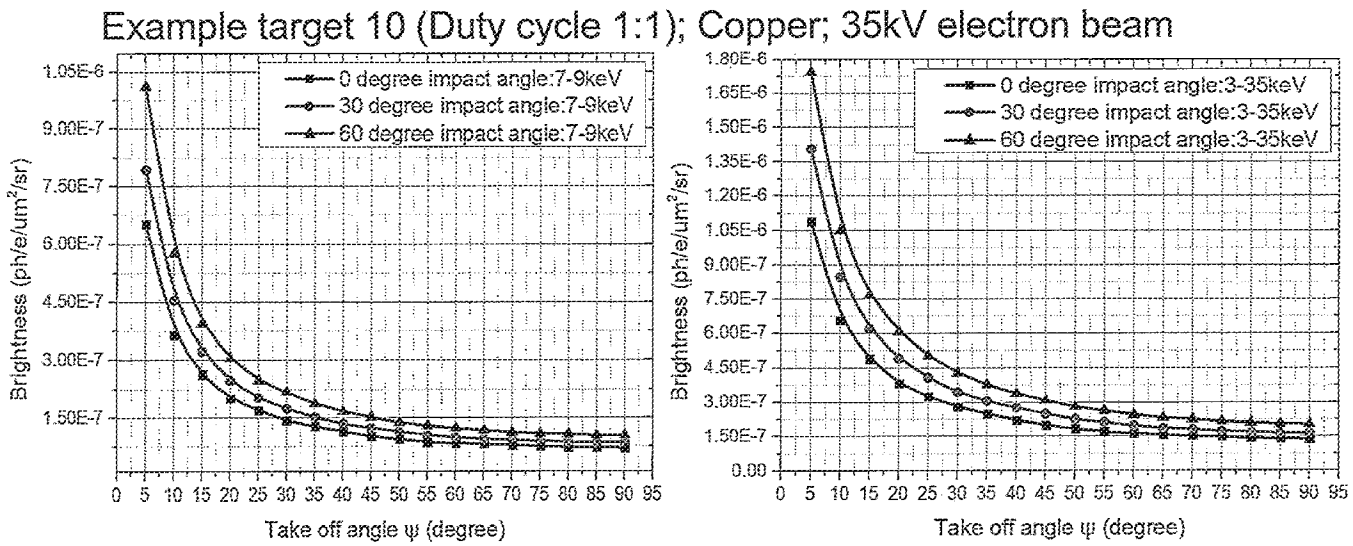

FIG. 5H compares the brightness of x-rays as a function of take-off angle and for three impact angles (0, 30, and 60 degrees) generated by a 35 kV electron beam and emitted from an example target 10 with structures 30 with a copper layer 40 in accordance with certain embodiments described herein with a duty cycle of 1:1. On the left side of FIG. 5H, the brightness for x-rays having energies of 7-9 keV is shown and on the right side of FIG. 5H, the brightness for x-rays having energies of 3-35 keV is shown.

Figure 5I:
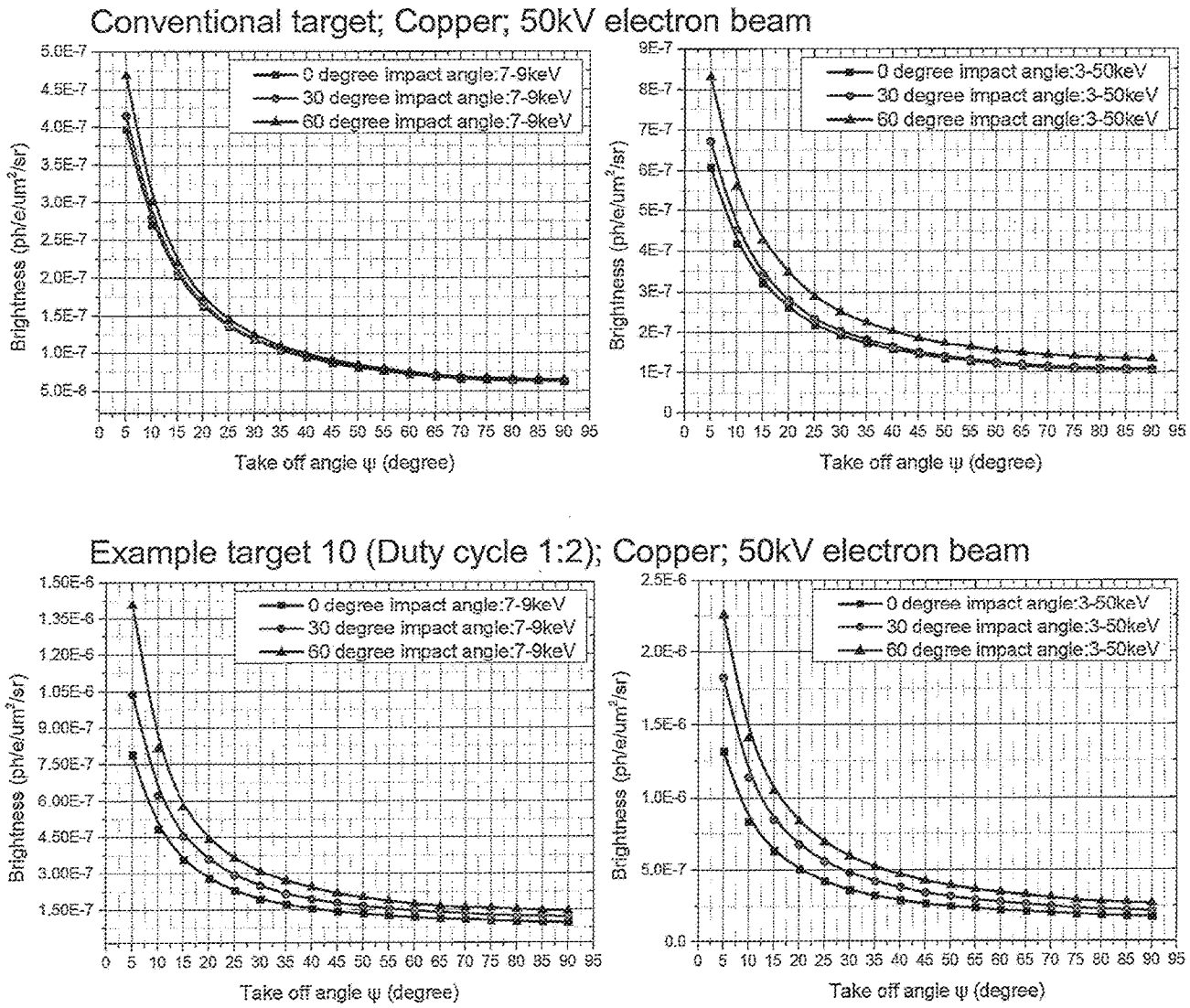

FIG. 5I compares the brightness of x-rays as a function of take-off angle and for three impact angles (0, 30, and 60 degrees) generated by a 50 kV electron beam and emitted from (i) a conventional copper target and (ii) an example target 10 with structures 30 with a copper layer 40 in accordance with certain embodiments described herein with a duty cycle of 1:2. On the left side of FIG. 5I, the brightness for x-rays having energies of 7-9 keV is shown and on the right side of FIG. 5I, the brightness for x-rays having energies of 3-50 keV is shown.

As shown by these simulation results, the example targets 10 in accordance with certain embodiments described herein exhibit higher brightnesses than do conventional targets. For a tungsten layer with an impact angle of 60 degrees and a take-off angle of 5 degrees and for the three electron beam energies (25 kV, 35 kV, 50 kV), Table 1A shows the brightnesses (photons/electron/$m^2$/steradian) of x-rays having energies 8-10 keV and Table 1B shows the brightnesses photons/electron/$m^2$/steradian) of x-rays having energies greater than 3 keV. These results were made assuming that the example target 10 exhibits four times the heat dissipation than the conventional target and with a correction of 1.3 times to account for higher electron scattering at the incident angle of 60 degrees as compared to 0 degrees.

TABLE 1A

| Electron Energy | Brightness from Conventional target | Brightness from Example target 10 | Brightness Ratio |
|---|---|---|---|
| 25 kV | 1.26E−07 | 3.64E−07 | 2.90 |
| 35 kV | 2.28E−07 | 8.02E−07 | 3.52 |
| 50 kV | 3.32E−07 | 1.42E−06 | 4.27 |

TABLE 1B

| Electron Energy | Brightness from Conventional target | Brightness from Example target 10 | Brightness Ratio |
|---|---|---|---|
| 25 kV | 3.85E−07 | 8.86E−07 | 2.30 |
| 35 kV | 6.12E−07 | 1.58E−06 | 2.59 |
| 50 kV | 8.98E−07 | 2.66E−06 | 2.96 |

For a copper layer with an impact angle of 60 degrees and a take-off angle of 5 degrees and for the three electron beam energies (25 kV, 35 kV, 50 kV), Table 2A shows the brightnesses (photons/electron/$m^2$/steradian) of x-rays having energies 7-9 keV and Table 2B shows the brightnesses photons/electron/$m^2$/steradian) of x-rays having energies greater than 3 keV. These results were made assuming that the example target 10 exhibits four times the heat dissipation than the conventional target and with a correction of 1.3 times to account for higher electron scattering at the incident angle of 60 degrees as compared to 0 degrees.

TABLE 2A

| Electron Energy | Brightness from Conventional target | Brightness from Example target 10 | Brightness Ratio |
|---|---|---|---|
| 25 kV | 1.85E−07 | 4.55E−07 | 2.46 |
| 35 kV | 2.96E−07 | 8.56E−07 | 2.89 |
| 50 kV | 4.69E−07 | 1.41E−06 | 3.00 |

TABLE 2B

| Electron Energy | Brightness from Conventional target | Brightness from Example target 10 | Brightness Ratio |
|---|---|---|---|
| 25 kV | 3.67E−07 | 8.52E−07 | 2.32 |
| 35 kV | 5.64E−07 | 1.43E−06 | 2.53 |
| 50 kV | 8.32E−07 | 2.26E−06 | 2.71 |

Various configurations have been described above. Although this invention has been described with reference to these specific configurations, the descriptions are intended to be illustrative of the invention and are not intended to be limiting. Various modifications and applications may occur to those skilled in the art without departing from the true spirit and scope of the invention. Thus, for example, in any method or process disclosed herein, the acts or operations making up the method/process may be performed in any suitable sequence and are not necessarily limited to any particular disclosed sequence. Features or elements from various embodiments and examples discussed above may be combined with one another to produce alternative configurations compatible with embodiments disclosed herein. Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

What is claimed is:

1. An x-ray target comprising:

a thermally conductive substrate comprising a surface; and a plurality of structures separate from one another and on or embedded in at least a portion of the surface, each of at least two structures of the plurality of structures comprising:

a thermally conductive first material in thermal communication with the substrate; and at least one layer over the first material, the at least one layer comprising at least one second material different from the first material, the at least one second material configured to generate x-rays upon irradiation by electrons, the first materials of the at least two structures separate from one another and the at least one layers of the at least two structures separate from one another.

2. The x-ray target of claim 1, wherein the first material of each of the at least two structures extends along a direction parallel to the portion of the surface by a distance in a range of 0.2 millimeter to 3 millimeters.

3. The x-ray target of claim 1, wherein the first material of each of the at least two structures extends along a direction parallel to the portion of the surface by a distance in a range of 1 millimeter to 20 millimeters.

4. The x-ray target of claim 1, wherein separations of adjacent structures of the plurality of structures are in a range of 1 millimeter to 4 millimeters.

5. The x-ray target of claim 1, wherein a separation along a direction parallel to the surface between adjacent edges of a first two adjacent structures of the plurality of structures is non-equal to a separation along the direction parallel to the surface between adjacent edges of a second two adjacent structures of the plurality of structures.

6. The x-ray target of claim 1, wherein the first material comprises diamond and/or silicon carbide.

7. The x-ray target of claim 1, wherein the at least one layer has a thickness in a range of 1 micron to 20 microns.

8. The x-ray target of claim 1, wherein the first materials of the at least two structures are the same as one another and the at least one second materials of the at least two structures are different from one another.

9. The x-ray target of claim 1, wherein a first structure of the at least two structures is configured to generate x-rays having a first energy spectrum and a second structure of the at least two structures is configured to generate x-rays having a second energy spectrum, the second energy spectrum different from the first energy spectrum.

10. The x-ray target of claim 1, wherein the at least one second material comprises at least one of: tungsten, chromium, copper, aluminum, rhodium, molybdenum, gold, platinum, iridium, cobalt, tantalum, titanium, rhenium, silicon carbide, tantalum carbide, titanium carbide, boron carbide, and alloys or combinations including one or more thereof.

11. An x-ray source comprising:

an x-ray target comprising:

a thermally conductive substrate comprising a surface; and a plurality of structures separate from one another and on or embedded in at least a portion of the surface, each of at least two structures of the plurality of structures comprising:

a thermally conductive first material in thermal communication with the substrate; and at least one layer over the first material, the at least one layer comprising at least one second material different from the first material, the first materials of the at least two structures separate from one another and the at least one layers of the at least two structures separate from one another; and an electron source configured to generate electrons in at least one electron beam and to direct the at least one electron beam to impinge the at least one structure.

12. The x-ray source of claim 11, wherein a largest extent of the first material of each of the at least two structures along a direction parallel to the portion of the surface is in a range of 0.2 millimeter to 3 millimeters and/or in a range of 1 millimeter to 20 millimeters.

13. The x-ray source of claim 11, wherein the at least one second material has a thickness less than an electron penetration depth of the electrons in the at least one second material.

14. The x-ray source of claim 11, wherein the at least one electron beam has an electron beam spot on the plurality of structures, the electron beam spot having a first dimension in a first direction parallel to the portion of the surface in a range of 5 microns to 20 microns and a second dimension in a second direction parallel to the portion of the surface and perpendicular to the first direction in a range of 20 microns to 200 microns.

15. The x-ray source of claim 11, wherein the at least one electron beam has an electron beam spot on the plurality of structures, the electron beam spot having an aspect ratio in a range of 4:1 to 10:1.

16. The x-ray source of claim 11, wherein the at least one electron beam impinges the plurality of structures such that a center line of the at least one electron beam is at a non-zero angle relative to a direction perpendicular to the portion of the surface.

17. The x-ray source of claim 11, wherein at least one of the x-ray target and the at least one electron beam is configured to be controllably moved such that the at least one electron beam impinges a selected one of the plurality of structures.

18. A method comprising:

impinging a first selected structure of a plurality of structures with at least one electron beam, the plurality of structures separate from one another and on or embedded in at least a portion of a surface of a thermally conductive substrate, each of at least two structures of the plurality of structures comprising:

a thermally conductive first material in thermal communication with the substrate; and at least one layer over the first material, the at least one layer comprising at least one second material different from the first material, the at least one second material configured to generate x-rays in response to being impinged by the at least one electron beam;

controllably moving the substrate and/or the at least one electron beam relative to one another; and impinging a second selected structure of the plurality of structures with the at least one electron beam.

19. The method of claim 18, wherein the x-rays generated in response to said impinging the first selected structure have a first energy spectrum and the x-rays generated in response to said impinging the second selected structure have a second energy spectrum that is different from the first energy spectrum.

20. The method of claim 18, wherein the plurality of structures are within a sealed region and said controllably moving the at least one of the substrate and the at least one electron beam occurs while the plurality of structures remain within the sealed region.

21. The method of claim 18, wherein said controllably moving the substrate and/or the at least one electron beam relative to one another comprises moving the substrate along a direction parallel to the surface.

22. An x-ray target comprising:

a thermally conductive substrate comprising a surface;

a first structure on or embedded in at least a portion of the surface, the first structure comprising:

a thermally conductive first material in thermal communication with the substrate; and at least one first layer over the first material, the at least one first layer comprising at least one second material different from the first material, the at least one second material configured to generate x-rays upon irradiation by electrons; and a second structure on or embedded in at least a second portion of the surface, the second structure separate from the first structure, the second structure comprising:

a thermally conductive third material in thermal communication with the substrate, the third material separate from the first material and the at least one first layer; and at least one second layer over the third material, the at least one second layer comprising at least one fourth material different from the third material, the at least one fourth material configured to generate x-rays upon irradiation by electrons, the at least one second layer separate from the first material and the at least one first layer.

* * * * *